US008443753B2

(12) United States Patent
Tanaka et al.

(10) Patent No.: US 8,443,753 B2
(45) Date of Patent: May 21, 2013

(54) FILM FORMING APPARATUS AND METHOD FOR FORMING FILM

(75) Inventors: Hideki Tanaka, Chino (JP); Hideo Shimamura, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 868 days.

(21) Appl. No.: 12/035,663

(22) Filed: Feb. 22, 2008

(65) Prior Publication Data

US 2008/0206472 A1 Aug. 28, 2008

(30) Foreign Application Priority Data

Feb. 23, 2007 (JP) ..... 2007-044474

(51) Int. Cl.

| | |
|---|---|
| ***B05B 3/00*** | (2006.01) |
| ***B05B 7/16*** | (2006.01) |
| ***B05C 5/00*** | (2006.01) |
| ***B05D 1/02*** | (2006.01) |

(52) U.S. Cl.
USPC ..... 118/323; 118/302; 118/321; 427/427.3

(58) Field of Classification Search
USPC ..... 118/300–325; 427/427.3; 347/22–36
See application file for complete search history.

(56) References Cited

U.S. PATENT DOCUMENTS

| | | | | |
|---|---|---|---|---|
| 6,033,474 | A * | 3/2000 | Mita et al. | 118/58 |
| 6,063,190 | A * | 5/2000 | Hasebe et al. | 118/52 |
| 6,673,155 | B2 * | 1/2004 | Nagashima et al. | 118/666 |
| 7,041,172 | B2 * | 5/2006 | Bem et al. | 118/313 |
| 2003/0175414 | A1 * | 9/2003 | Hayashi | 427/66 |
| 2004/0047995 | A1 * | 3/2004 | Krueger | 427/346 |
| 2007/0020918 | A1 * | 1/2007 | Hirokawa et al. | 438/626 |

FOREIGN PATENT DOCUMENTS

| | | |
|---|---|---|
| JP | A-2001-157863 | 6/2001 |
| JP | A 2003-84124 | 3/2003 |
| JP | A-2003-340339 | 12/2003 |
| JP | A-2004-255330 | 9/2004 |
| JP | A-2004-351260 | 12/2004 |
| JP | A-2006-159037 | 6/2006 |

* cited by examiner

*Primary Examiner* — Rakesh Dhingra
(74) *Attorney, Agent, or Firm* — Oliff & Berridge, PLC

(57) ABSTRACT

A film forming apparatus includes a processing chamber defined by walls, an application preparation room in which an applicator is temporary provided, a first carrier transporting the applicator from the application preparation room to the processing chamber, a stage on which a substrate is disposed and a maintenance part disposed adjacent to the application preparation room. A liquid is applied from the applicator onto the substrate to form a film on the substrate.

12 Claims, 25 Drawing Sheets

FILM FORMING APPARATUS AND METHOD FOR FORMING FILM

The entire disclosure of Japanese Patent Application No. 2007-044474, filed Feb. 23, 2007 is expressly incorporated by reference herein.

BACKGROUND OF THE INVENTION

1. Technical Field

The present invention relates to an apparatus and a method for forming a film, particularly to a film processing apparatus (processing method) using a droplet discharge device.

2. Related Art

An ink-jet device, which is an example of a droplet discharge device, discharges a liquid (solution) that is stored inside from a nozzle opening which is placed at the bottom of a pressure chamber by pressurizing the pressure chamber through a piezoelectric element. Such ink-jet devices are widely used in industry not only for an ink-jet printer but also for a discharging operation in a manufacturing process, for example, in the fabrication process of a color filter for a display.

An ink-jet device for industrial use discharges various kinds of liquid. For example, there is a solution which reacts with oxygen in the air and whose quality can be deteriorated.

JP-A-2003-84124 is an example of related art. The example discloses an ink-jet device in which an ink-jet head (22) and the like are covered in a cover 14 as shown in FIG. 5 of the example.

Techniques for preventing the deterioration or change in the quality of a discharge liquid have been studied, and for example a technique in which discharge of an ink-jet is performed under an inactive gas atmosphere has been investigated. Looking at the equipment disclosed in the example in this aspect, the whole equipment is covered so that it takes time to purge the inactive gas (replace the gas inside). Consequently the usage of the inactive gas is increased and the manufacturing cost is also increased. This problem becomes more prominent when a substrate size becomes larger.

SUMMARY

An advantage of the invention is to provide an apparatus and a method for forming a film by which control of a processing atmosphere becomes easy, throughput is enhanced and a manufacturing cost of a product is reduced.

1) A film forming apparatus according to a first aspect of the invention includes a processing chamber defined by walls, an application preparation room in which an applicator is temporary provided, a first carrier transporting the applicator from the application preparation room to the processing chamber, a stage on which a substrate is disposed and a maintenance part disposed adjacent to the application preparation room. A liquid is applied from the applicator onto the substrate to form a film on the substrate.

According to the first aspect of the invention, maintenance of the applicator can be efficiently carried out by the maintenance part. Furthermore, the maintenance part is provided separately from the processing chamber so that it is possible to prevent the external air from entering into the processing chamber.

It is preferable that the processing chamber be made a closed space with the walls, the first carrier and a part having the stage. In this way the distance between the stage and the applicator (the first carrier) is made smaller and the volume of the processing chamber becomes smaller. Consequently it is possible to make the control of the atmosphere inside easy. More specifically, it is possible to reduce the time period which takes for purging the processing chamber by an inactive gas. Moreover it is possible to cut the amount of the inactive gas used for the purge.

It is also preferable that the stage serve as a second carrier that transports the substrate to the processing chamber. In this way, the substrate can be easily transported to the processing chamber.

It is preferable that the applicator be transported from the application preparation room to the maintenance part by a third carrier. In this way, the applicator can be carried by the third carrier.

More preferably the applicator is transported in a first direction and the maintenance part is disposed in a second direction that crosses the first direction of the application preparation room. In this way, it is possible to provide the maintenance part with a simple structure in the apparatus.

In this case, the maintenance part may further include a cleaner part for cleaning the applicator. In this way, it is possible to conduct the cleaning of the applicator in the maintenance part.

In this case, the apparatus may further include a space for replacing the applicator in the maintenance part. In this way, the replacement of the applicator can be performed in the maintenance part.

In this case, the apparatus may further include an openable wall disposed between the application preparation room and the maintenance part. In this way, it is possible to make the transportation of the applicator more easier.

It is preferable that the first carrier be a plate-shaped member that covers an upper part of the processing chamber and the applicator be embedded in the plate-shaped member. In this way, the applicator can be moved by sliding the plate-shaped member while keeping the closed space.

It is preferable that the apparatus further include a heater embedded in the plate-shaped member. In this way, it is possible to perform a heat process of the substrate by the heater.

More preferably the heater is embedded in the plate-shaped member such that the heater is situated in the processing chamber when the applicator is situated in the application preparation room. In this way, it is possible to move the applicator and the heater in conjunction with a process.

2) A film forming apparatus according to a second aspect of the invention includes a first processing chamber and a second processing chamber defined by walls and whose upper part and lower part are covered so as to form a closed space, a substrate being disposed either in the first processing chamber or the second processing chamber; an applicator disposed in the first processing chamber; and a heater disposed in the second processing chamber.

In this way, application can be performed in the first chamber and heating can be carried out in the second processing chamber.

3) A method for forming a film according to a third aspect of the invention includes transporting an applicator from an application preparation room in which the applicator is temporary disposed to a processing chamber, applying a liquid from the applicator onto a substrate, returning the applicator to the application preparation room, transporting the applicator from the application preparation room to a maintenance part that is provided adjacent to the application preparation room and conducting maintenance of the applicator in the maintenance part.

In this way, the substrate can be transported from the processing chamber while the applicator is situated in the application preparation room. In addition, it, is possible to carry out the maintenance of the applicator efficiently by the maintenance part.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described. The identical or relative numerals are given to the same structures or structures having the same function, and those explanations will not be repeatedly described in the following description.

First Embodiment

Structure of Liquid Discharge Device

Figure 1:
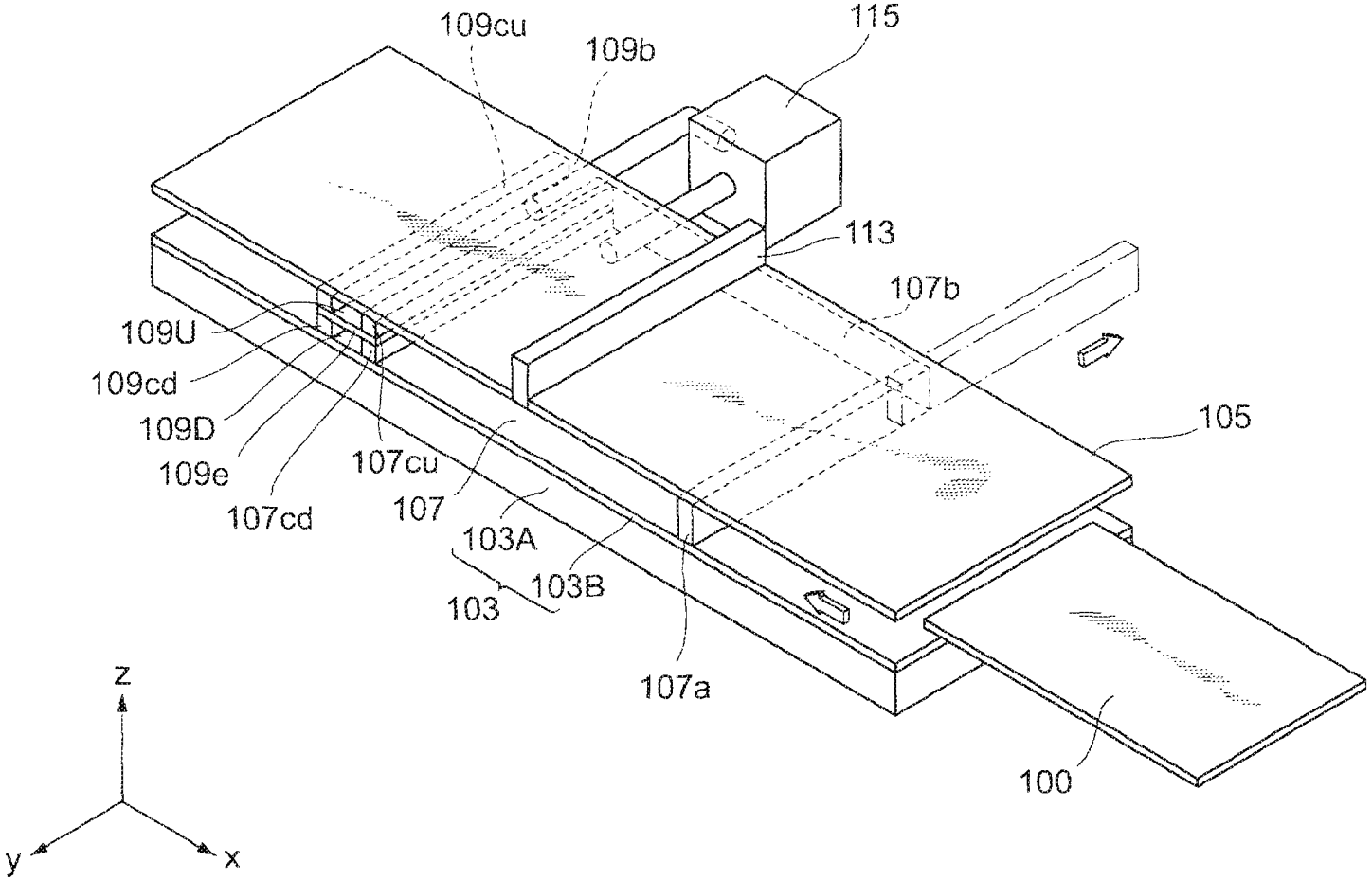
FIG. 1 is a sectional perspective view of a droplet discharge device according to a first embodiment.
Figure 2:
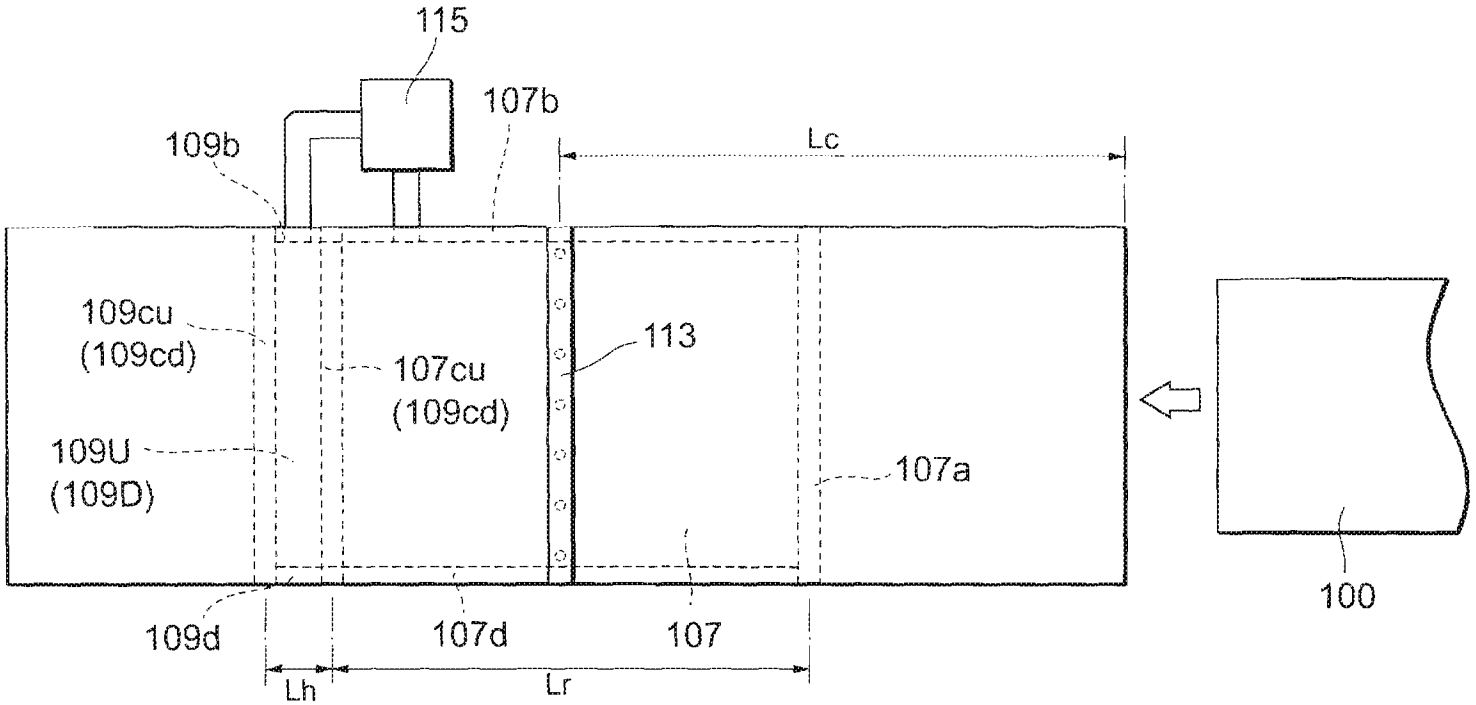
FIG. 2 is a top view of the droplet discharge device according to the first embodiment.
Figure 3:
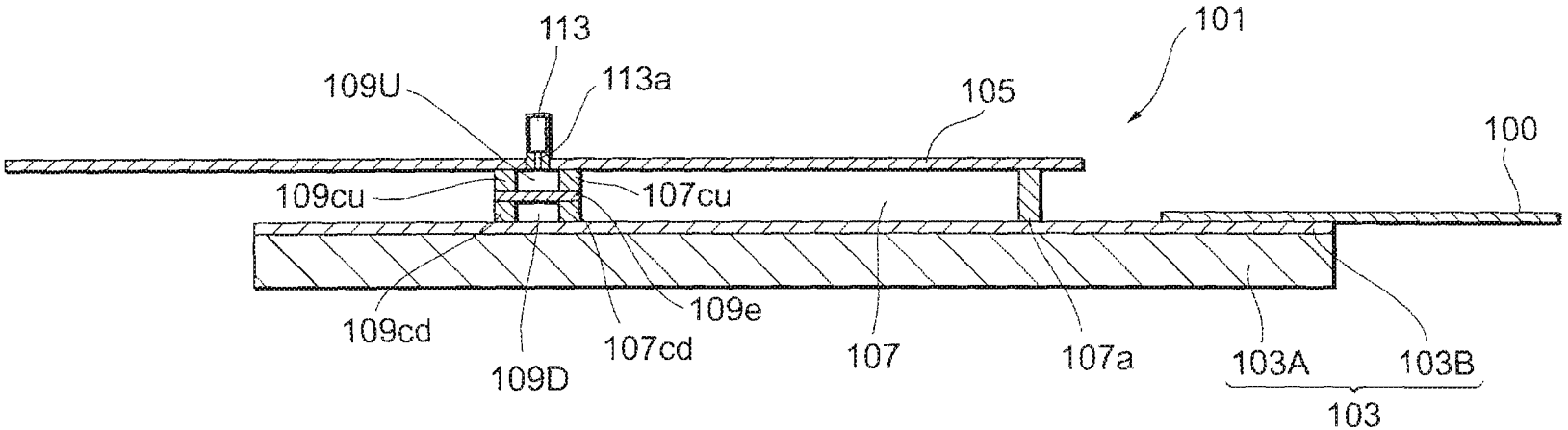
FIG. 3 is a sectional view of the droplet discharge device according to the first embodiment.

FIGS. 1 through 3 show a droplet discharge device (in other words a liquid application device, an ink-jet device) according to a first embodiment of the invention. FIG. 1, is a sectional perspective view, FIG. 2 is a top view, and FIG. 3 is a sectional view of the droplet discharge device.

Referring to FIGS. 1 through 3, a droplet discharge device 101 according to the embodiment includes a substrate carrier stage 103, a ceiling board 105 with which an ink-jet head 113 (in other words a discharger, an applicator) is embedded, and side walls (107*a*, 107*b*, 107*cu*, 107*cd*, 107*d*, 109*b*, 109*cu*, 109*cd*, 109*d*). Among the side walls, one which is openable and closable is referred as to an "openable wall".

A processing chamber 107 (a processing room) is surrounded by the above-mentioned parts and a closed space is provided. Here, the "closed space" encompasses the space which is temporary closed and does not particularly mean the space which is permanently closed.

The dimensions (length, width and height) of the closed space (processing chamber) is set for example in about 50 mm longer than the length of a substrate, 50 mm wider than the width of the substrate and 5-20 mm higher than the thickness of the substrate. Obviously the dimensions of the processing chamber can be appropriately set based on a standard size of the substrate which is treated therein in order to meet various types of substrates. The positions of the walls can also be adequately changed and a combination of the walls (including the position of a head, home 109U) can be changed according to a size of a substrate.

The head home 109U (in other words, an application preparation room or a stand-by room) is provided adjacent to the processing chamber 107. The head home 109U is also surrounded by the substrate carrier stage 103, the ceiling board 105 with which the ink-jet head 113 is embedded, and the side walls (107*cu*, 109*b*, 109*cu*, 109*d*) and a closed space is formed therein. A space (109D) under the head home 109U serves as a transfer channel (path) for a substrate. This space is bounded by a board 109*e*.

The substrate carrier stage 103 includes a fixed stage 103A and a carrier 103B which is placed above the stage 103A. A substrate 100 is transported from right to left in FIG. 1 by the carrier 103B and then placed in the processing chamber 107.

This transportation of the substrate is carried out by for example sliding (moving) the carrier 103B which has a plate shape.

The wall 107*a* is the openable wall and it opens when for example the wall is slid from the front side to the back side (y-direction) in FIG. 1. The walls 107*cd* and 119*cd* are also the openable walls and have the same structure.

The ink-jet head 113 is embedded in the ceiling board 105. By sliding the ceiling board 105 in the right and left direction (x-direction) in FIG. 1, the ink-jet head 113 can be shifted above the substrate 100 while keeping the processing chamber 107 as the closed space. The ink-jet head 113 is moved in a scanning way (drawing) and can discharge (applies) a droplet on the substrate. The ceiling board 105 can be referred as the carrier part of the ink-jet head 113.

A nozzle opening (discharge aperture) of the ink-jet head 113 and the ceiling board 105 are provided in a substantially same plane. Most part of the ink-jet head 113 protrudes out from the ceiling board 105. In this way, it is possible to reduce the volume of the processing room.

The ink-jet head 113 is placed above the head home 109U after the discharge treatment (discharge process) is finished.

A gas supplier 115 is coupled to the processing chamber 107 and to the head home 109U through a pipe, and an inactive gas such as nitrogen ($N_2$) and argon (Ar) can be purged from (or filled, introduced into) the processing chamber 107 and the inside of the head home 109U. Here "purge" means that the air (oxygen and the like) remaining in the processing chamber is replaced by an inactive gas, and the oxygen concentration in the processing chamber is reduced to for example some ppm order.

In the droplet discharge device according to the embodiment, the closed space which serves as the processing chamber 107 is formed with the substrate carrier stage 103, the ceiling board 105 with which the ink-jet head 113 is embedded, and the side walls (107*a*, 107*b*, 107*cu*, 107*cd*, 107*d*). Thereby it is possible to make the distance between the substrate carrier stage 103 and the ceiling board 105 small and the volume of the processing chamber 107 can be made small. Consequently it is possible to reduce the time period which takes for purging the processing chamber 107 by an inactive gas. Moreover it is possible to cut the amount of the inactive gas used for the purge. As a result, throughput of the substrate 100 is improved and a manufacturing cost can be reduced.

Though the closed space is formed only with the substrate carrier stage 103, the side walls (107*a*, 107*b*, 107*cu*, 107*cd*, 107*d*) and the ceiling board 105 in this embodiment, the configuration is not particularly limited to this and various modifications are possible. For example, a fixed stage (floor) can be provided at the both sides of the substrate carrier stage. Alternatively the both sides of the ceiling board can be made fixed and the middle part of the board can be made movable. As long as the closed space (processing chamber) is provided with the parts including the substrate carrier stage 103, the side walls and the ceiling board 105, any configuration is possible. In other words, it is only required that the substrate carrier stage 103 at least forms a part of the bottom face of the closed space and the ceiling board 105 forms at least a part of the upper face of the closed space.

Furthermore, according to the droplet discharge device, the discharge process can be performed under an inactive gas atmosphere so that the deterioration or change in the quality of the liquid inside the head and the quality of discharged droplets can be made less. Therefore the quality of the product can be improved.

Moreover, the droplet discharge device according to the embodiment has the head home 109U so that the inside of the head home can be purged by an inactive gas, and the substrate 100 can be moved from the processing chamber 107 after the ink-jet head 113 is stowed away. Thereby the ink-jet head 113 will not contact with the ambient air (atmosphere) and the deterioration or change in the quality of the liquid inside the head can be reduced.

Furthermore, according to the embodiment, it is possible to perform preparations for the next discharge operation such as wiping out of the ink-jet head 113 and weight measurement of a droplet. The wiping is conducted in order to clean droppings of the liquid around the nozzle opening 113*a*. The weight measurement of a droplet is performed by discharging a droplet on a trial basis to see if a predetermined amount is actually discharged. It is preferable that the preparations are conducted by a means which is provided in the head home 109U without contacting the outside air.

Though the substrate 100 is transported into the processing chamber 107 by the substrate carrier stage 103 in the above-described embodiment, the upper part of the processing chamber 107 can be opened by sliding the ceiling board 105. The substrate is transported through there and can be placed on a stage (table) of the processing chamber 107. In this case, it is not necessary to install the carrier mechanism on the stage.

The structure of the openable wall is not particularly limited to the above-mentioned one. For example, it can be made openable in a vertical direction. However the processing chamber 107 is made smaller when the wall is formed such that it slides in the y-direction as shown in FIG. 1.

Figure 4:
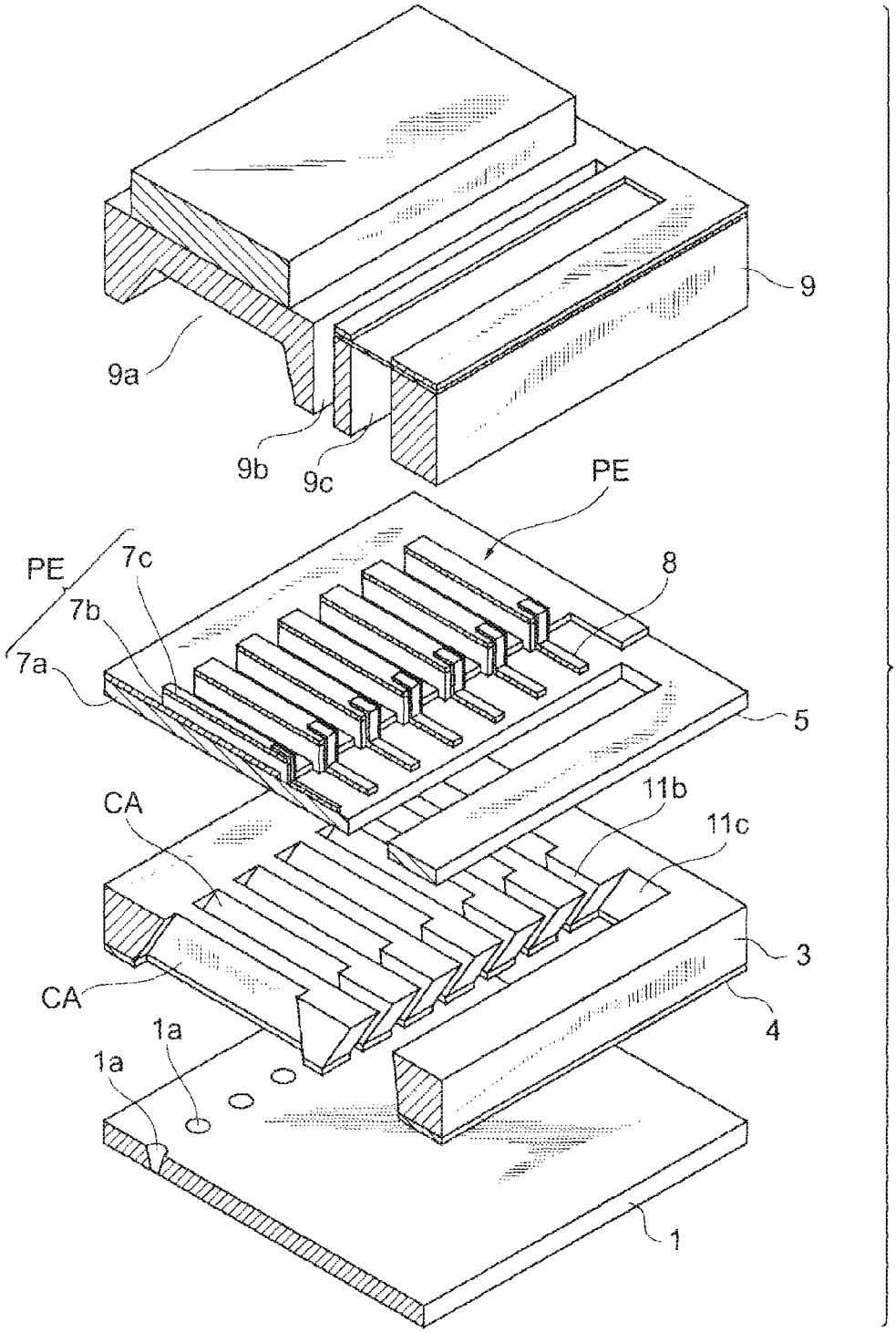
FIG. 4 is an exploded perspective view of an ink-jet head 113 showing its configuration example.

There are various types of the ink-jet head 113. One of configuration examples of the ink-jet head is shown in FIG. 4. FIG. 4 is an exploded perspective view of the ink-jet head 113 showing the structure inside. Referring to FIG. 4, the ink-jet head has a pressure chamber CA (or a cavity, a concave portion) and a Piezoelectric element PE which is disposed over the pressure chamber.

The pressure chamber CA has a bottom face, a side wall and a top face. A nozzle plate 1 forms the bottom face, a silicon substrate 3 (a flow passage substrate) forms the side wall, and a diaphragm 5 forms the top face of the pressure chamber. An aperture part is provided in the silicon substrate 3 and this aperture part becomes the pressure chamber CA. The aperture part includes opening regions 11*a*, 11*b*, 11*c* and the opening regions 11*b*, 11*c* serve as flow passages for a liquid.

A nozzle opening 1*a* is provided in the bottom face of the pressure chamber CA. The nozzle opening 1*a* is provided corresponding to the pressure chamber CA which is provided in the plural number in the nozzle plate 1.

The Piezoelectric element PE is disposed above the pressure chamber CA or over the diaphragm 5. The Piezoelectric element PE has a layered structure in which a lower electrode 7*a* is formed at the bottom, on top of which a piezoelectric film 7*b* (a piezoelectric layer) is formed, and on top of which an upper electrode 7*c* is formed. The piezoelectric film 7*b* is made of for example lead zirconate titanate (or PZT; Pb ($Zr_{1-x}Ti_x$)). An external extended electrode 8 is disposed on the upper part of the Piezoelectric element PE (or on the upper electrode 7*c*).

A protection substrate 9 (a sealing resin) is disposed over the Piezoelectric element PE. A concave portion 9*a*, and opening regions 9*b*, 9*c* are provided in the protection substrate 9. The Piezoelectric element PE is disposed in the concave portion 9*a*. A compliance substrate and the like are disposed on the protection substrate 9.

A liquid is supplied from the flow passage 11*c* (reservoir) to the pressure chamber CA through the flow passage 11*b*.

The pressure chamber CA is pressurized when the Piezoelectric element is driven and the liquid is discharged from the nozzle opening 1*a*.

Though the nozzle opening 1*a* is disposed along the edge of the nozzle plate 1 in FIG. 4 for the sake of simplicity of the drawing, the layout of the pressure chamber CA and the nozzle opening 1*a* can be freely decided. For example, the nozzle opening 113*a* can be placed at substantially the center of the bottom face of the ink-jet head 113 as shown in FIG. 1.

Film Forming Method Using the Droplet Discharge Device

A method for forming a film (a film forming method) on the substrate 100 by using the above-described droplet discharge device is now described with reference to FIGS. 5 through 11. At the same time, the structure and the operation of the droplet discharge device according to the embodiment will be described more in detail. FIGS. 5 through 11 are sectional views showing the process of the film forming method according to the embodiment.

Figure 5:
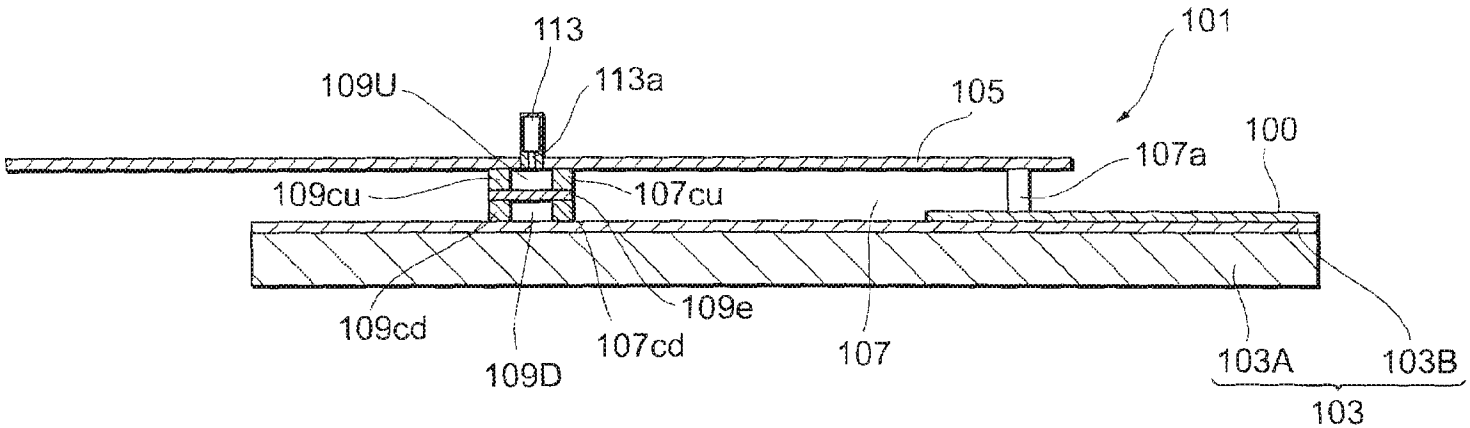
FIG. 5 is a sectional view showing a process of a film forming method according to the first embodiment.

Referring to FIG. 5, the openable wall 107*a* is opened and the substrate 100 is transported in the processing chamber 107 by the substrate carrier stage 103. At this point, the ink-jet head 113 is situated above the head home 109U. The head home 109U is purged by using an inactive gas.

Figure 6:
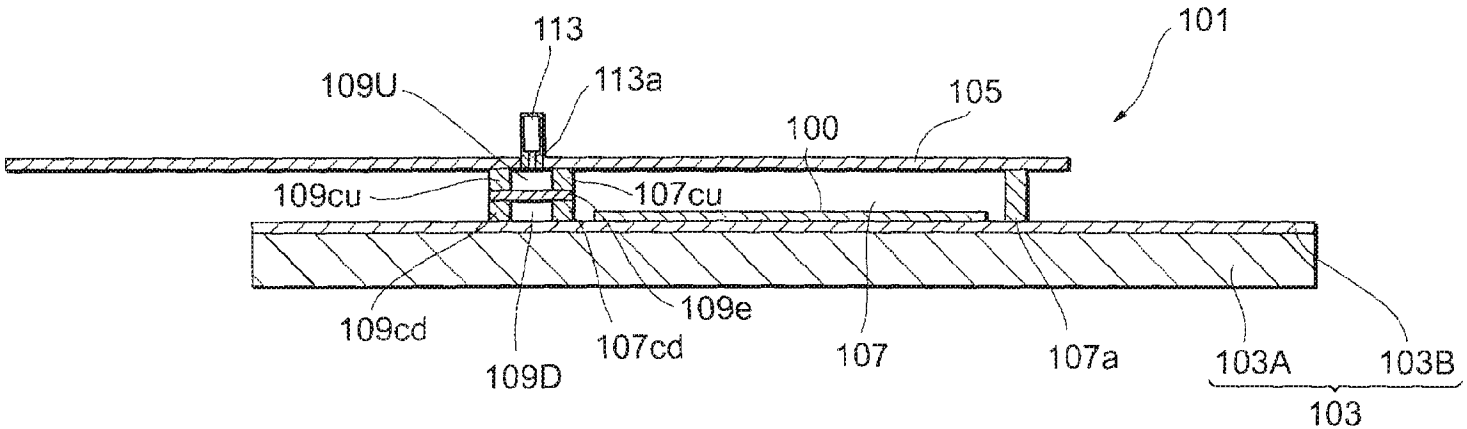
FIG. 6 is a sectional view showing a subsequent process of the film forming method according to the first embodiment.

Referring to FIG. 6, the openable wall 107*a* is then closed thereby the processing chamber 107 becomes a closed space. Subsequently the processing chamber 107 is purged by an inactive gas.

Figure 7:
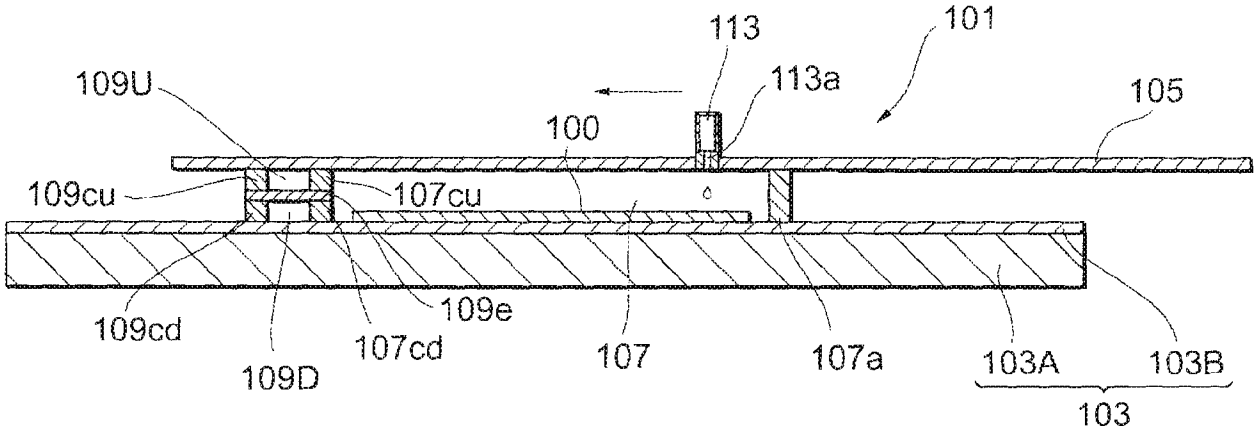
FIG. 7 is a sectional view showing a subsequent process of the film forming method according to the first embodiment.
Figure 8:
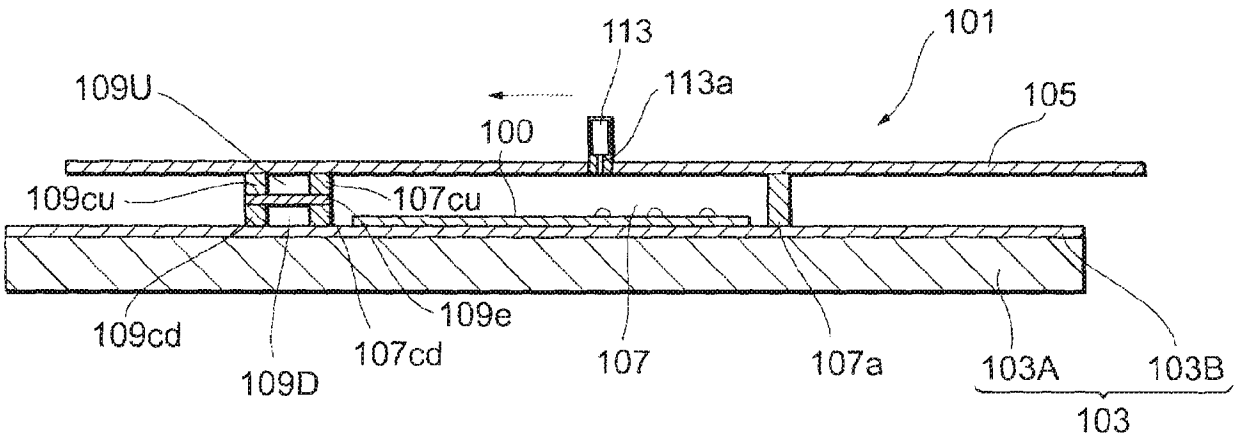
FIG. 8 is a sectional view showing a subsequent process of the film forming method according to the first embodiment.
Figure 9:
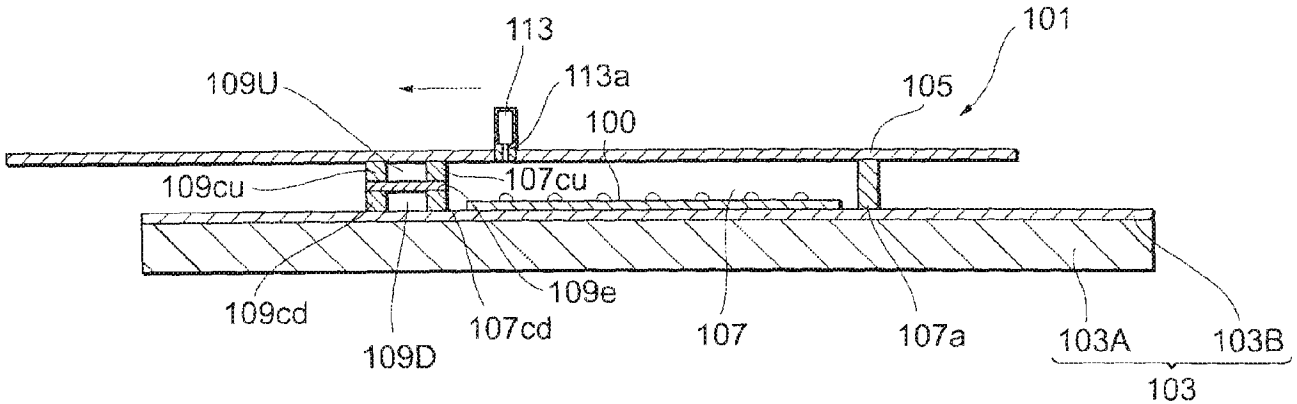
FIG. 9 is a sectional view showing a subsequent process of the film forming method according to the first embodiment.
Figure 10:
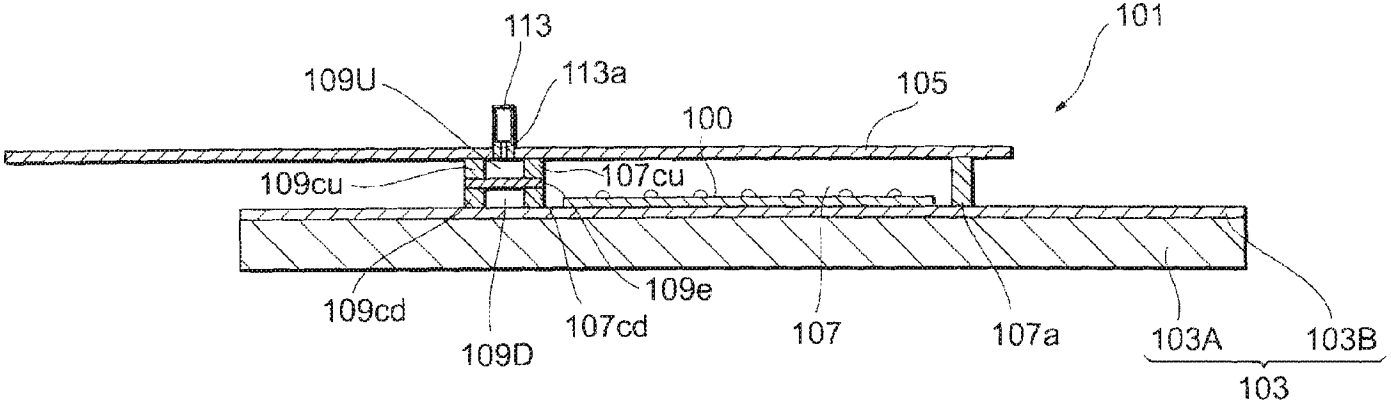
FIG. 10 is a sectional view showing a subsequent process of the film forming method according to the first embodiment.

Referring now to FIG. 7, the ink-jet head 113 is aligned with the area where a film is to be formed on the substrate 100 by sliding the ceiling board 105. In FIG. 7, the ink-jet head 113 is situated in the right side end of the substrate 100. Droplets are discharged from the ink-jet head 113. Referring to FIG. 8 and FIG. 9, the ceiling board 105 is then moved to the left side in the drawing, the ink-jet head is placed right above the next film forming area, and droplets are then discharged. In this way, the ceiling board 105 is sequentially moved and droplets are discharged.

During the discharging process, the head home 109U is purged by an inactive gas. If the head home 109U has been already purged in the preceding process it is not necessary to purge again. When the discharging process is finished, the ink-jet head 113 is returned to the original position above the head home 109U (see FIG. 10). Meanwhile, the wall 107*cu* can be made the openable wall and it can be used to let the inkjet head 113 through when the head is transported. In this case also the processing chamber 107 is purged by an inactive gas so that the air will not enter into the head home 109U.

Subsequently the processing chamber 107 is heated by an unshown heater, the droplets are dried (a solvent is volatilized) and baking (solidification) is further performed. When the heating is conducted, the inkjet head 113 is not placed in the processing chamber 107 but inside the head home 109U so that deterioration of the liquid in the head caused by heat can be prevented. The temperature inside the head home 109U can be controlled by for example introducing or circulating a coolant inactive gas in the head home 109U. More specifically, a gas cooling part can be provided inside the gas supplier 115 or around a pipe which couples the gas supplier 115 with the head home 109U thereby a cooled inactive gas can be introduced into the processing chamber 107.

Through the above-described process, the film is formed in a desired position on the substrate 100. Here, more than one film can be formed and arranged in array. Such films are formed for example when a color filter (a CF substrate) which is disposed on a pixel electrode in a liquid crystal display is manufactured. A film having a linear pattern can be also formed by discharging droplets sequentially such that each droplet overlaps with the other. Other than these, films having various shapes can be formed by changing the number of the droplet discharge operations, the discharge amount and the like.

Figure 11:
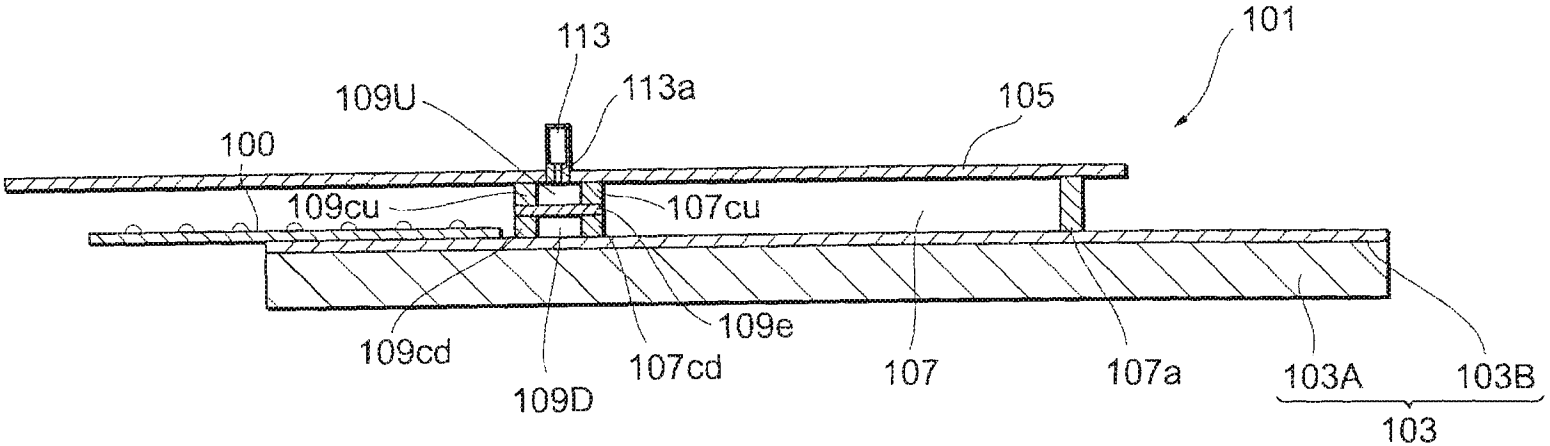
FIG. 11 is a sectional view showing a subsequent process of the film forming method according to the first embodiment.

Referring to FIG. 11, the openable walls 107*cd*, 109*cd* are opened and the substrate 100 is transported through the transfer channel 109D. As described above, the ink-jet head 113 is stored inside the head home 109U at this point so that it will not contact with the external air. Alternatively the substrate 100 can be moved out through the openable wall 107*a*.

According to the embodiment, the content of the processing chamber 107 can be made smaller and the control of the atmosphere inside becomes easier. More specifically, it is possible to reduce the time which takes for purging by using an inactive gas and to reduce the amount of the inactive gas used. In addition, the head home 109U can prevent the ink-jet head 113 from contacting the outside air.

Second Embodiment

In a second embodiment, other configuration examples of the substrate carrier stage 103, the ceiling board 105 and the ink-jet head 113 and will be described. The identical numerals are given to the same structures as the first embodiment and those explanations are hereunder omitted.

CONFIGURATION EXAMPLE 1

In the above-described first embodiment, the substrate 100 is transported when the plate-shaped carrier 103B is slid as shown in FIG. 3. Alternatively, the substrate 100 can be transported by using a conveyor belt as shown in FIG. 12. FIG. 12 is a sectional view of a droplet discharge device according to this embodiment and showing a method for forming a film by using the droplet discharge device.

Figure 12A:
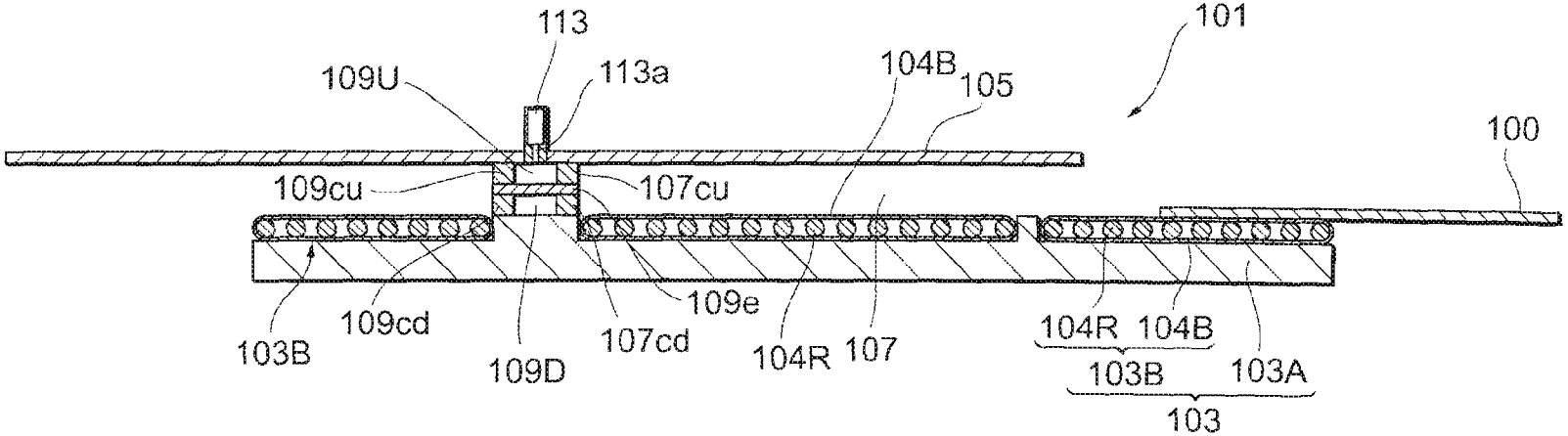
FIG. 12 is a sectional view of a droplet discharge device according to a second embodiment and showing a method for forming a film by using the droplet discharge device.

Referring to FIG. 12A, the carrier 103B of the substrate carrier stage 103 is formed by the conveyor belts. The carrier 103B includes three conveyor belts 103B (carriers). Each conveyor belt 103B has a roller 104R which is provided in the plural number, and a belt 104B which is disposed around the rollers 104R. The belt 104B moves when the rollers 104R rotate and the substrate 100 is transported.

Figure 12B:
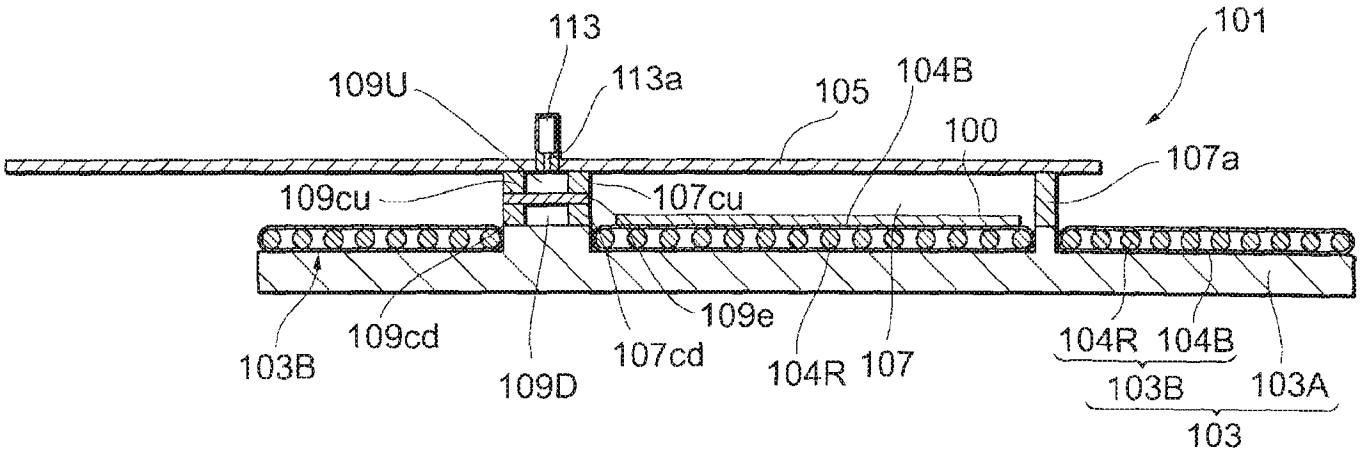

Referring to FIG. 12B, the substrate 100 is moved onto the conveyor belt 103B at the bottom of the processing chamber from the right side of the conveyor belt 103B in the drawing, and the openable wall 107*a* is closed. A discharge operation is then performed in the same manner as the first embodiment.

After the discharging process, the ink-jet head 113 is returned to the head home 109U. The openable walls 107*cd*, 109*cd* are opened and the substrate 100 which is placed on the conveyor belt 103B at the bottom of the processing chamber 107 is then moved onto the left side of the conveyor belt 103B in the drawing.

CONFIGURATION EXAMPLE 2

In a second configuration example, an elevator (104U) is provided on the conveyor belt 103B at the bottom of the processing chamber 107. FIG. 13 is a sectional view of a droplet discharge device according to this example and showing a method for forming a film by using the droplet discharge device.

Referring to FIG. 13, the conveyor belt 103B at the bottom of the processing chamber 107 has an elevating rod 104U (an elevator or an elevating mechanism). The elevating rod 104U pushes up the conveyor belt 103B and its height can be adjusted.

Figure 13A:
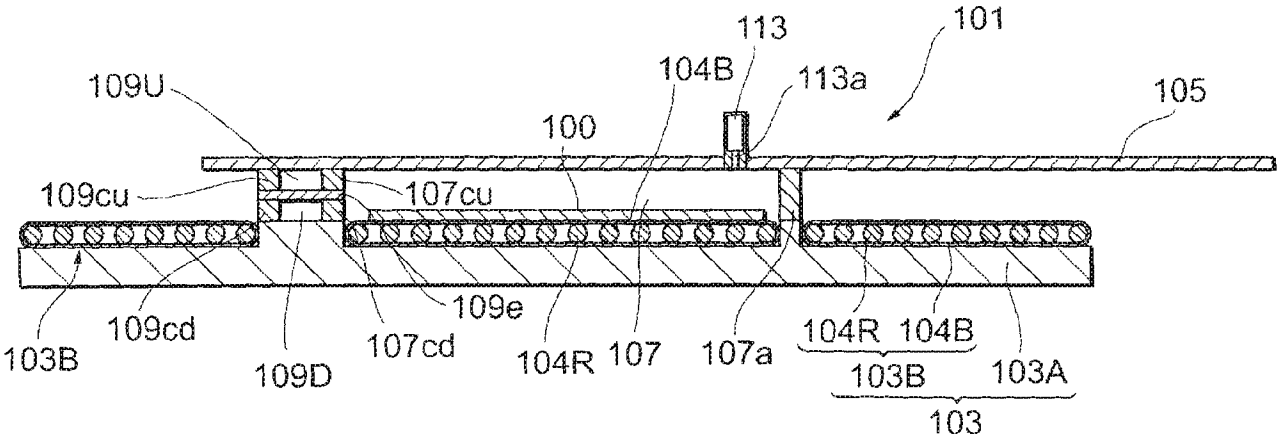
FIG. 13 is a sectional view of the droplet discharge device according to the second embodiment and showing the method for forming a film by using the droplet discharge device.
Figure 13B:
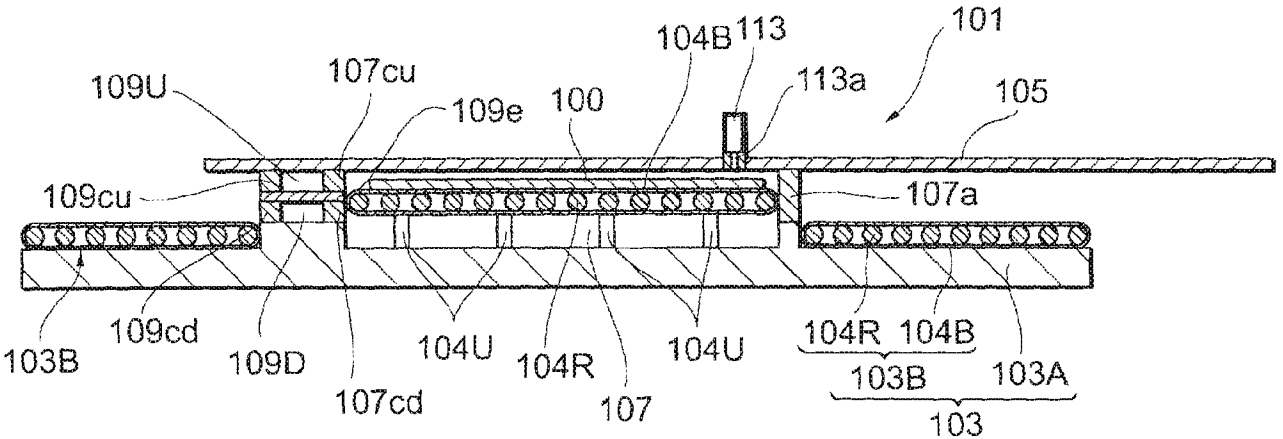

Referring to FIG. 13A, the substrate 100 is placed inside the processing chamber 107 in the same way as the above-described first configuration example. The conveyor belt 103B itself is then pushed up by the elevating rod 104U and the substrate 100 is lifted up (see FIG. 13B). The ink-jet head 113 is driven in a scanning manner over the substrate 100 and droplets are discharged onto the substrate 100 in the same manner as the first embodiment.

In this way, the height of the substrate 100 (the distance between the substrate 100 and the ink-jet head 113) can be changed by the elevating rod 104U according to the second configuration example. The elevation of the substrate 100 can be optimized corresponding to the amount of the droplets discharged or property of the droplets. Therefore it is possible to improve the accuracy of the discharge operation. The elevator is not limited to the above-described rod but various modifications are possible.

CONFIGURATION EXAMPLE 3

Though the elevator (104U) is provided on the conveyor belt 103B in the above-described second configuration example, the elevator can be alternatively provided on the ceiling board 105. And the ink-jet head 113 can be embedded in the ceiling board 105 such that it can be moved up and down. FIG. 14 is a sectional view of a droplet discharge device according to this example and showing a method for forming a film by using the droplet discharge device.

Referring to FIG. 14, the ink-jet head 113 is embedded in the ceiling board 105 such that it can be lifted up and down.

Figure 14A:
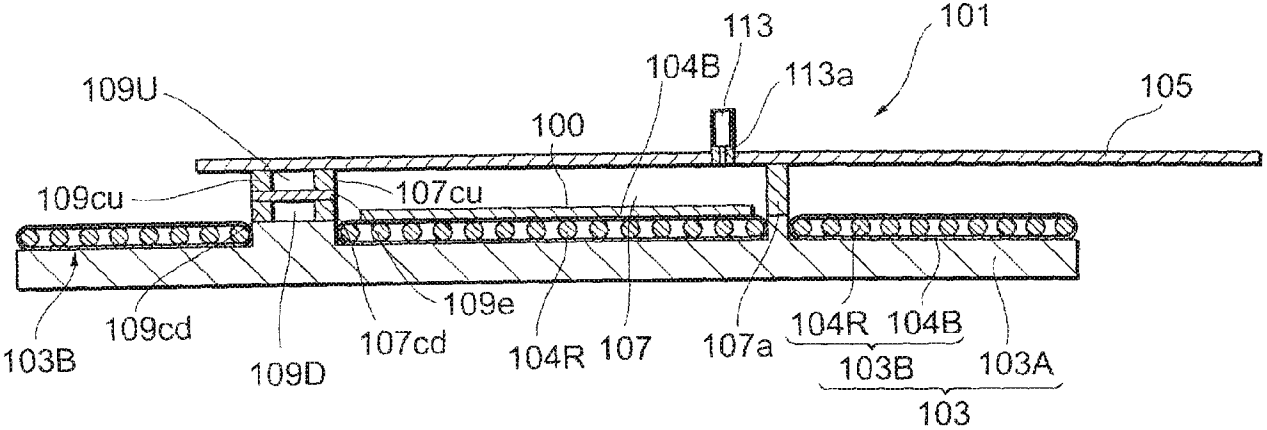
FIG. 14 is a sectional view of the droplet discharge device according to the second embodiment and showing the method for forming a film by using the droplet discharge device.
Figure 14B:
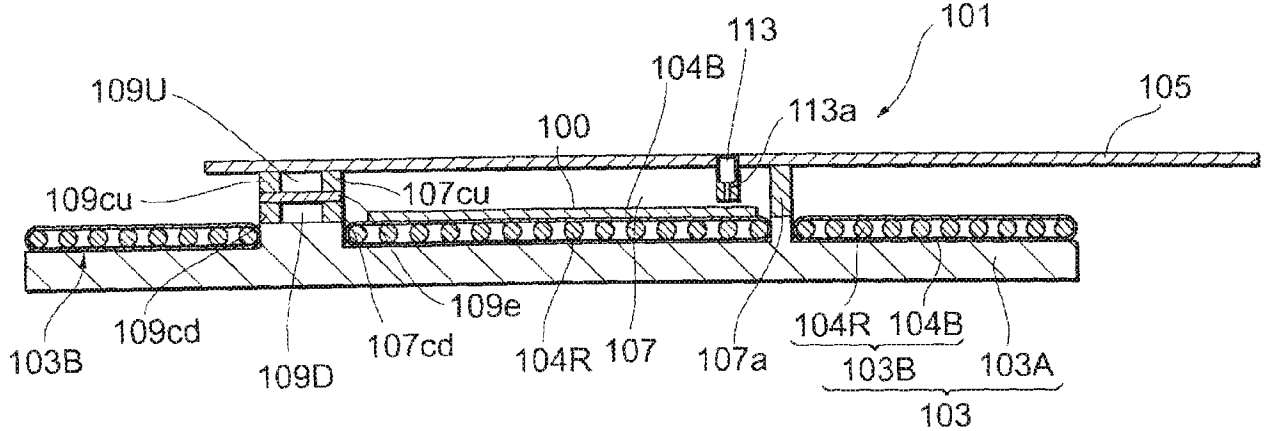

Referring to FIG. 14A, after the substrate 100 is placed inside the processing chamber 107 in the same way as the first configuration example, the ink-jet head 113 is moved down (see FIG. 14B). The ink-jet head 113 is then driven in a scanning manner over the substrate 100 and droplets are discharged onto the substrate 100 in the same manner as the first embodiment.

In this way, the ink-jet head 113 can be lifted up and down. Thereby the distance between the substrate 100 and the ink-jet head 113 (nozzle opening 113*a*) can be optimized according to the amount of the droplets discharged or property of the droplets. Therefore it is possible to improve the accuracy of the discharge operation.

Third Embodiment

In the first embodiment, the inkjet head is embedded in the ceiling board 105 as shown in FIG. 3. A lamp 117 (heater or heating part) can be further embedded there as shown in FIG. 15.

Figure 15:
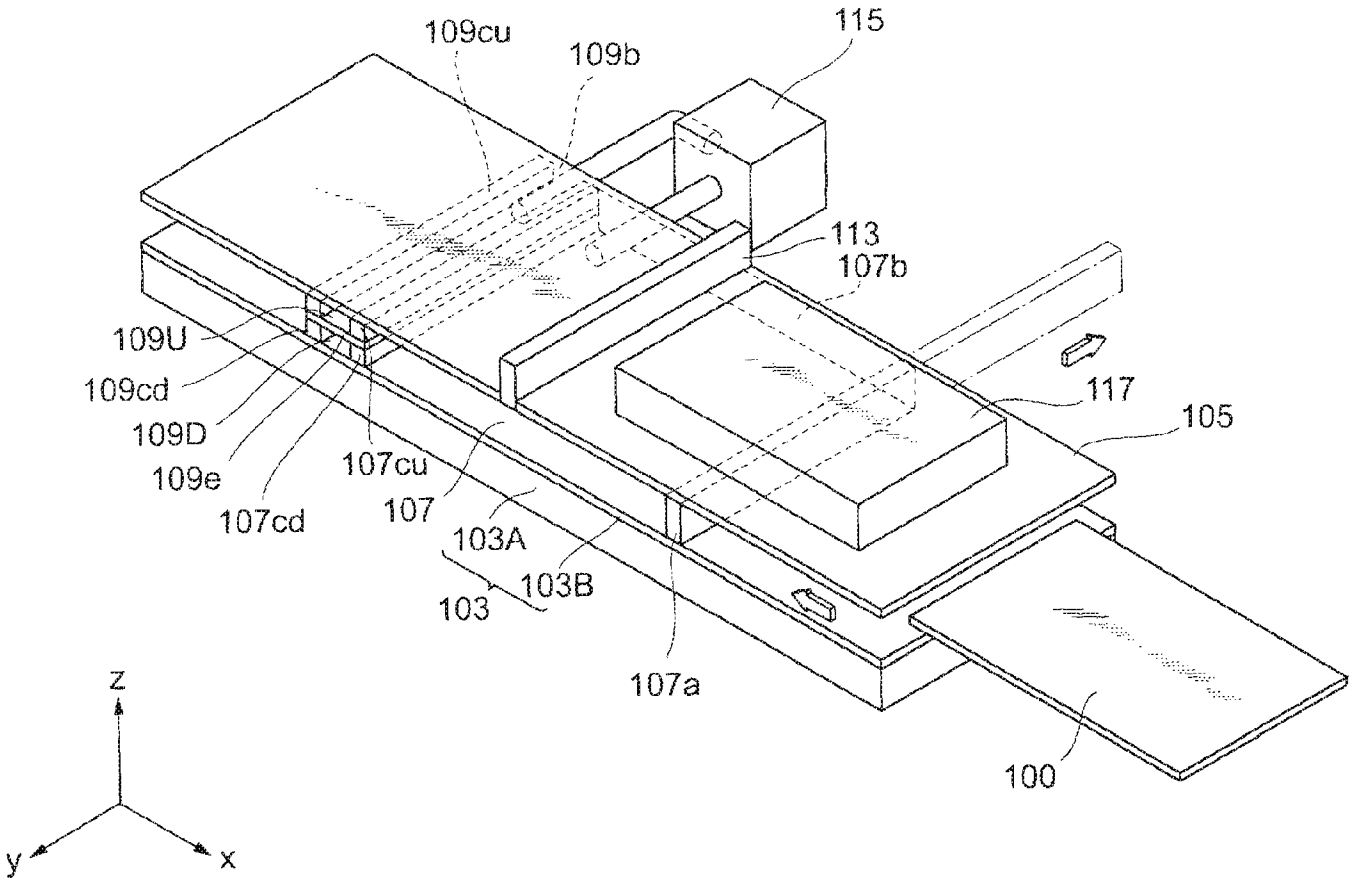
FIG. 15 is a sectional perspective view of a droplet discharge device according to a third embodiment.
Figure 16:
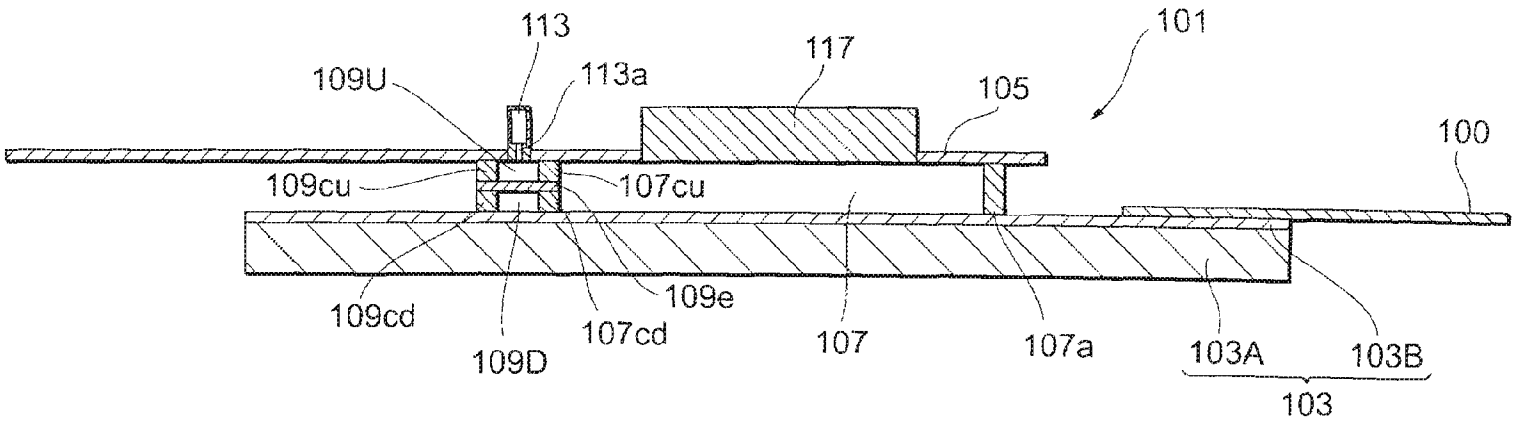
FIG. 16 is a sectional view of the droplet discharge device according to the third embodiment.

FIG. 15 and FIG. 16 show a droplet discharge device according to a third embodiment. FIG. 15 is a sectional perspective view and FIG. 16 is a sectional view of the droplet discharge device. Other structures except the lamp 117 are same as those in the first embodiment so that those explanations are hereunder omitted.

Referring to FIG. 16, the lamp 117 is disposed with a predetermined distance with respect to the ink-jet head 113 such that the lamp 117 is placed over the processing chamber 107 when the inkjet head 113 is situated over the head home 109U. The lamp 117 is for example embedded in an opening which is provided in the ceiling board 105 in such a way that an irradiation part of the lamp faces downward. As the lamp 117, a low-pressure mercury lamp, a halogen lamp, an xenon lamp or the like can be used.

A method for forming a film on the substrate 100 by using the above-described droplet discharge device 101 is now described with reference to FIGS. 17 through 21. At the same time, the structure and the operation of the droplet discharge device according to the embodiment will be described more in detail. FIGS. 17 through 21 are sectional views showing the process of the film forming method according to the embodiment.

Figure 17:
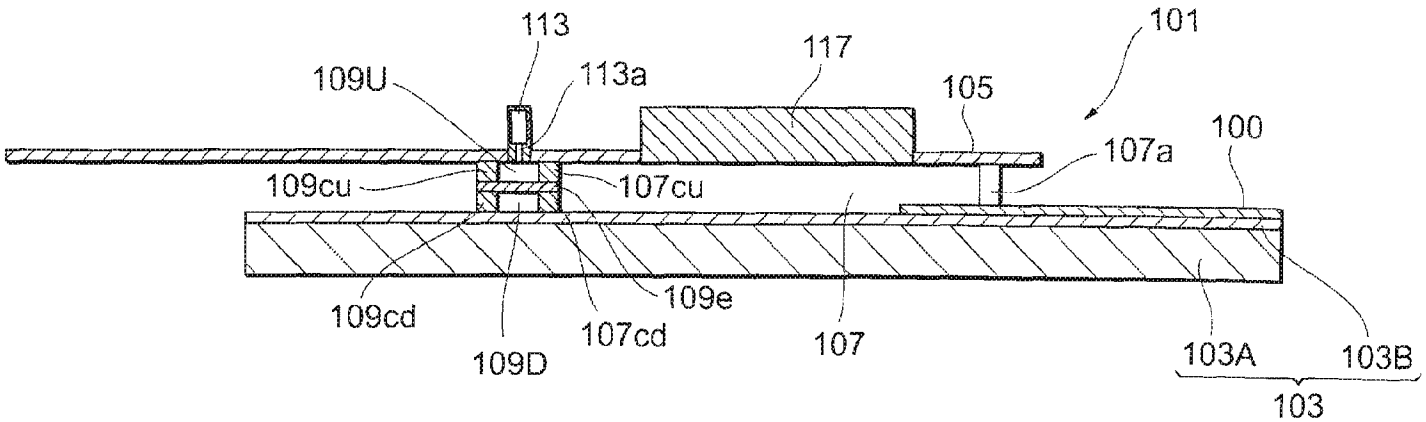
FIG. 17 is a sectional view showing a process of a film forming method according to the third embodiment.

Referring to FIG. 17, the openable wall 107*a* is opened and the substrate 100 is transported in the processing chamber 107 by the substrate carrier stage 103. At this point, the ink-jet head 113 is situated above the head home 109U and the lamp 117 is placed above the processing chamber 107. The head home 109U is purged by using an inactive gas.

Figure 18:
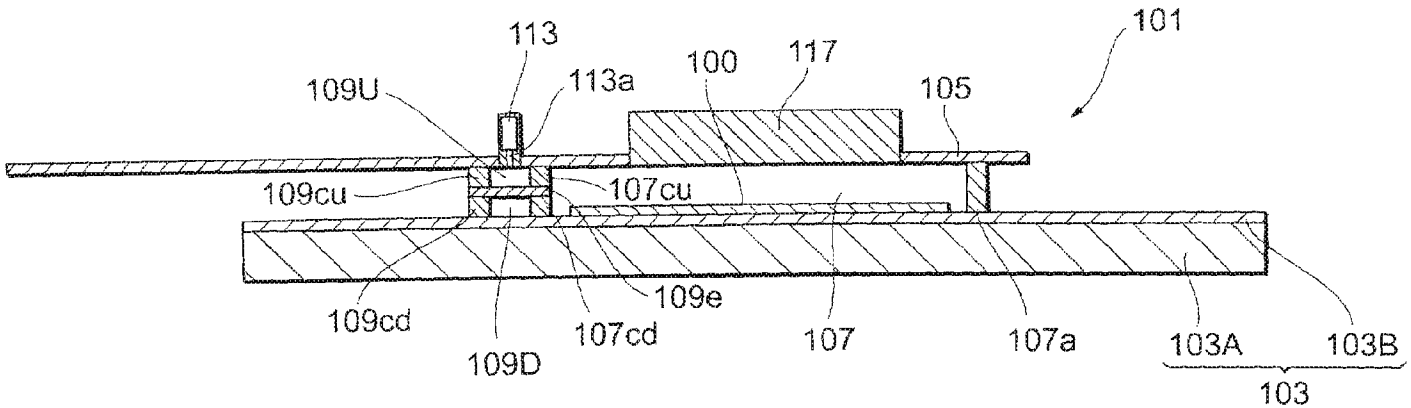
FIG. 18 is a sectional view showing a process of the film forming method according to the third embodiment.

Referring to FIG. 18, the openable wall 107*a* is then closed thereby the processing chamber 107 becomes a closed space. Subsequently the processing chamber 107 is purged by an inactive gas.

The substrate 100 is heated by the lamp 117 and an organic substance adhered to the substrate 100 is degraded and volatized. With the irradiation of the lamp 117, the substrate 100 can be cleaned. This cleaning can be performed by for example irradiating the substrate with a ultra-violet (UV) ray. In this case, it is preferable that the inside of the processing chamber 107 be made a low pressure. Moreover the lamp 117 may include two lamps, one for the cleaning and the other for the hereinafter-described heating. Meanwhile, this cleaning process can be omitted.

Figure 19:
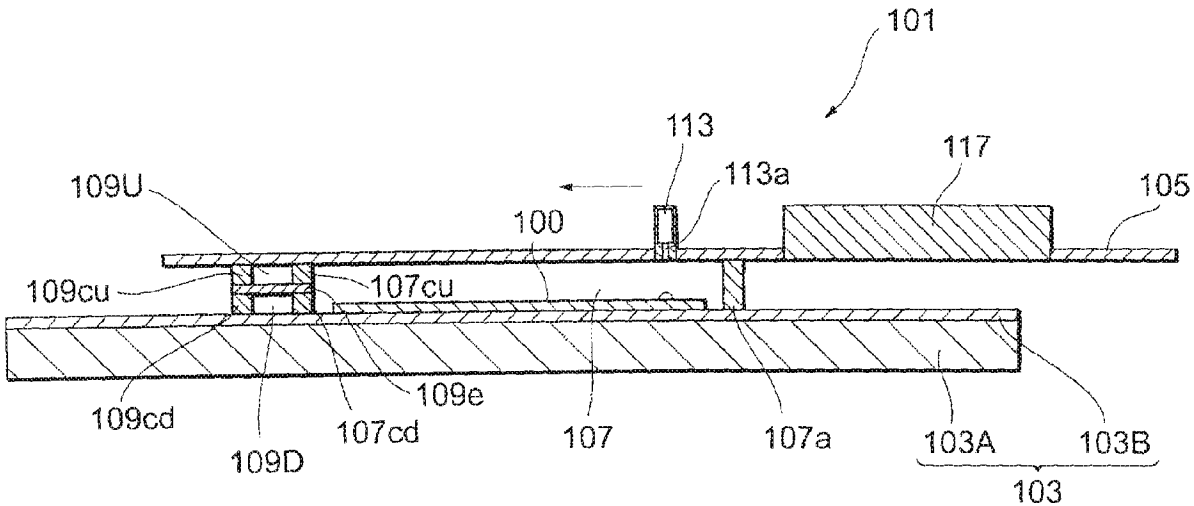
FIG. 19 is a sectional view showing a process of the film forming method according to the third embodiment.

Referring now to FIG. 19, the ink-jet head 113 is aligned with the area where a film is to be formed on the substrate 100 by sliding the ceiling board 105. In FIG. 19, the ink-jet head 113 is situated over the right side end of the substrate 100. Droplets are discharged from the ink-jet head 113. The ceiling board 105 is then moved to the left side in the drawing and droplets are sequentially discharged.

When the discharging process is finished, the ink-jet head 113 is returned to the original position above the head home 109U. Meanwhile, the wall 107*cu* can be made as the openable wall.

Figure 20:
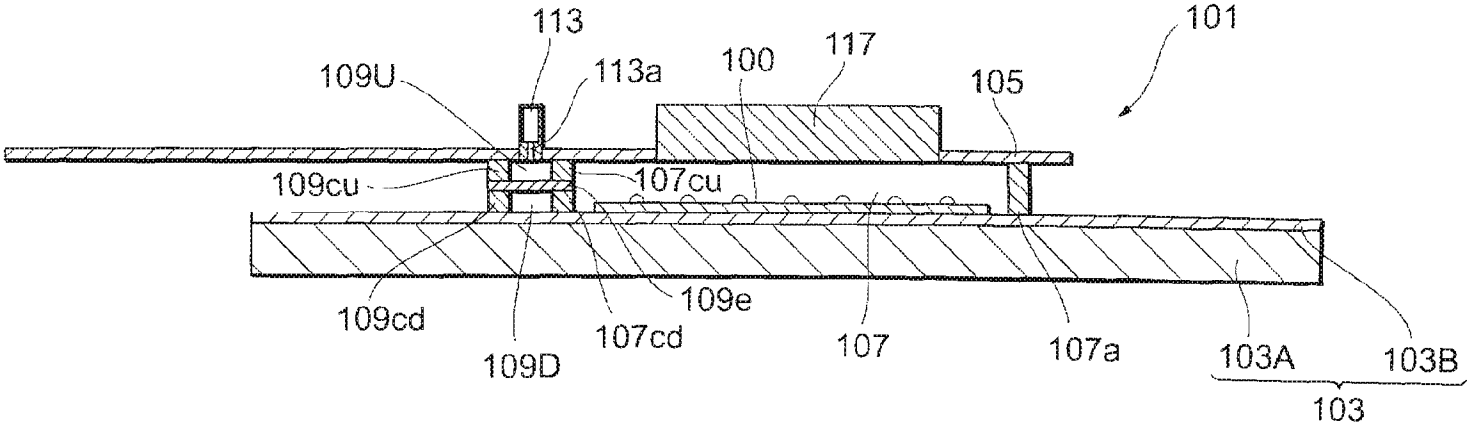
FIG. 20 is a sectional view showing a process of the film forming method according to the third embodiment.

When the ink-jet head 113 is returned to the above the head home 109U, the lamp 117 is placed over the processing chamber 107 (FIG. 20). The inside of the processing chamber 107 is heated by the lamp 117, and droplets existing there are dried and baked (solidified). Consequently a film can be formed at a desired position on the substrate 100 in the same way as the first embodiment.

Figure 21:
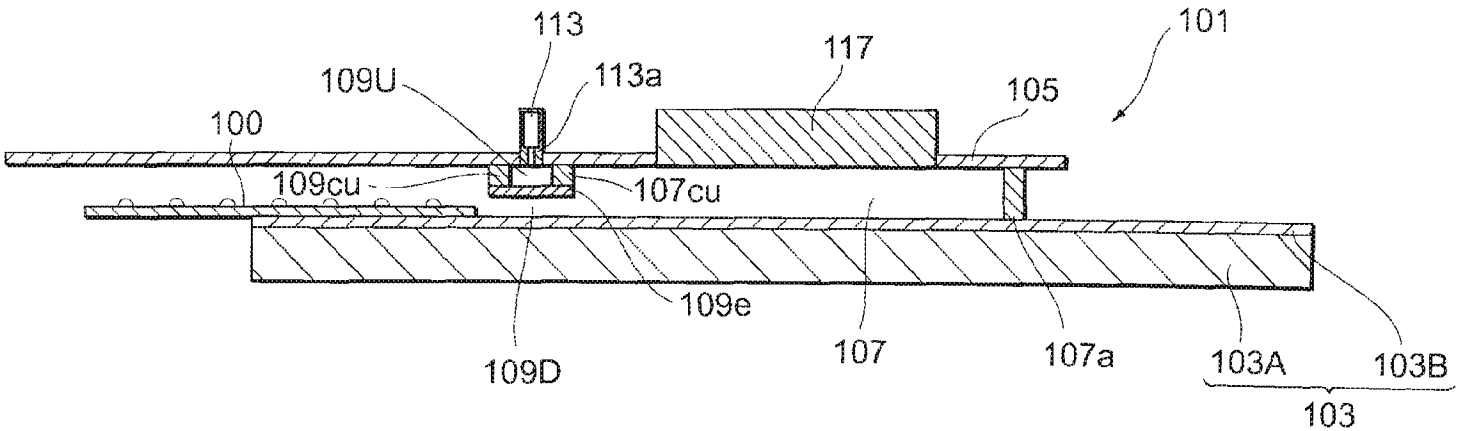
FIG. 21 is a sectional view showing a process of the film forming method according to the third embodiment.

Referring to FIG. 21, the openable walls 107*cd*, 109*cd* are opened and the substrate 100 is transported through the transfer channel 109D. As described above, the ink-jet head 113 is stored inside the head home 109U at this point so that it will not contact with the external air. Alternatively the substrate 100 can be moved out through the openable wall 107*a*.

According to the third embodiment, the same advantages effects as those of the first embodiment can be obtained. More specifically, the content of the processing chamber 107 can be made smaller. In addition, it is possible to reduce the time which takes for purging by using an inactive gas and to reduce the amount of the inactive gas used. Furthermore, the head home 109U can prevent the ink-jet head 113 from contacting the outside air.

Moreover, the lamp 117 is embedded in the ceiling board 105 according to the embodiment so that a heat treatment of the substrate 100 by the lamp 117 can be performed when the ceiling board 105 is slid. In addition, the lamp 117 is placed above the processing chamber when the ink-jet head 113 is situated right above the head home 109U. Thereby the droplet discharging operation by the ink-jet head 113 and the drying and baking operation by the lamp 117 can be performed smoothly in the same processing chamber 107.

Though the droplet discharge device is described in the embodiment, the ink-jet is not necessarily provided and it can be used as a heating device. Furthermore, a device part in which the ink-jet head 113 is fixed to the ceiling board 105 and another device (heating device) part in which the lamp 117 is fixed to the ceiling board 105 can be disposed adjacently and the discharging, drying and baking processes can be performed in the respective device part (processing chamber).

According to the above-described embodiment, the ink-jet head 113 and the lamp 117 are sequentially placed over the single processing chamber depending on a process. However, a first processing chamber and a second processing chamber both of which are the closed space can be for example provided. In this case, the inkjet head 113 is placed above the first processing chamber and can perform the discharging operation, the substrate is then transported to the second processing chamber, and the lamp which is situated right above the second processing chamber can perform a heat treatment.

Though the lamp is adopted as a heating means in the embodiment, other heating means such as a heater can also be used.

Fourth Embodiment

Though only one processing chamber 107 is provided in the device according to the third embodiment described with reference to FIG. 15, two processing chambers can be provided in the device.

Figure 22:
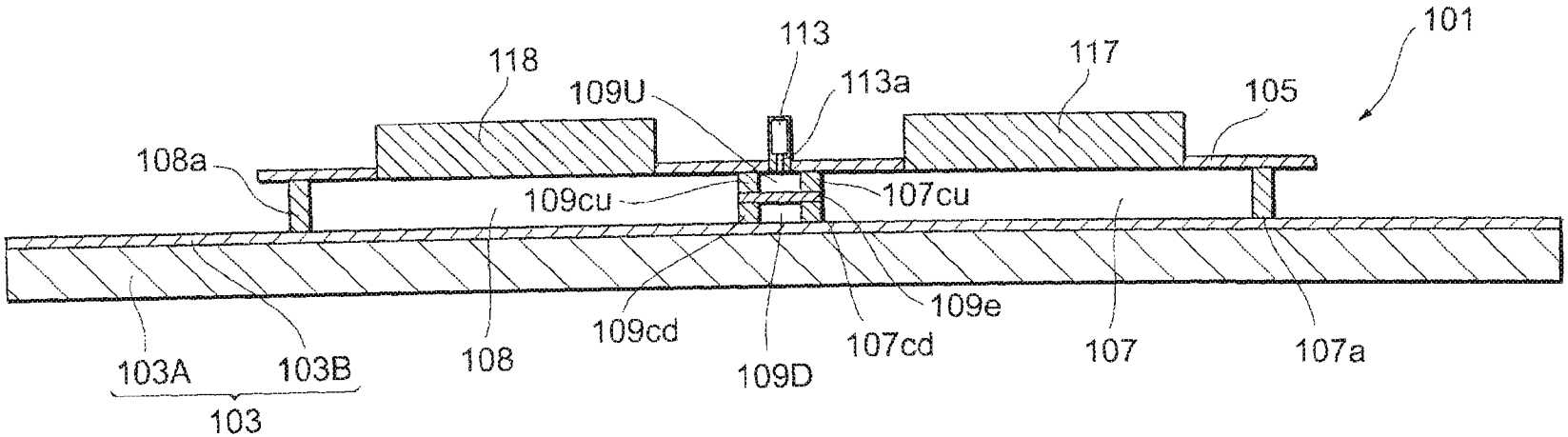
FIG. 22 is a sectional view of a droplet discharge device according to a fourth embodiment.
Figure 23:
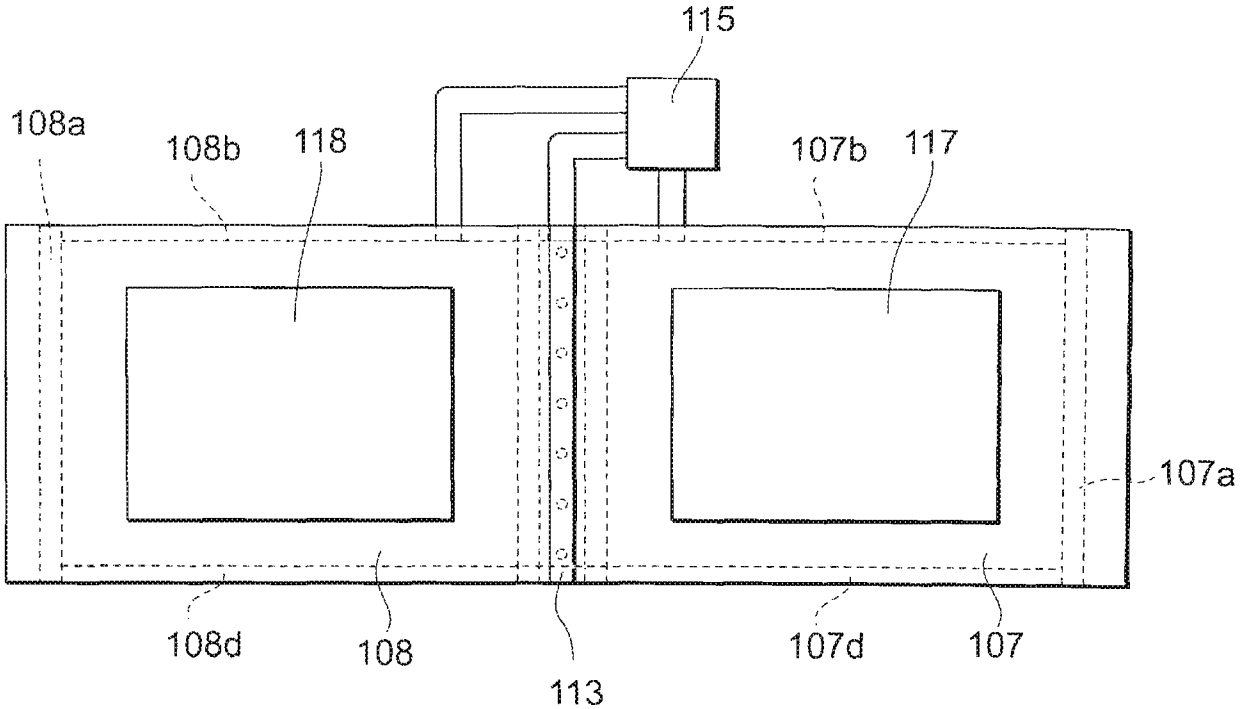
FIG. 23 is a top view of the droplet discharge device according to the fourth embodiment.

FIG. 22 and FIG. 23 show a droplet discharge device according to a fourth embodiment. FIG. 22 is a sectional view and FIG. 23 is a top view of the droplet discharge device. The identical numerals are given to the same structures as the first and third embodiments and those explanations are hereunder omitted.

Referring to FIG. 22 and FIG. 23, in the droplet discharge device according to the fourth embodiment, the processing chamber 107 is placed in the right side with respect to the head home 109U in the drawing, and a processing chamber 108 is provided in the left side with respect to the head home 109U in the drawing. The processing chamber 108 is surrounded (delineated or defined) by an openable wall 108*a*, a side wall 109*cu*, an openable wall 109*cd* and side walls 108*b*, 108*d*. The ceiling board 105 is placed such that it extends over the processing chambers 107, 108 when the ink-jet head 113 is situated above the head home 109U. The substrate carrier stage 103 extends at the bottom of the processing chambers 107, 108. These components (the side walls, the openable wall, the ceiling board 105 and the substrate carrier stage 103) enclose the processing chambers 107, 108 and the closed spaces are formed there.

The device according to this embodiment further has two lamps 117, 118. The lamps 117, 118 are disposed with a predetermined distance with respect to the ink-jet head 113 such that they are placed above the processing chambers 107, 108 respectively when the ink-jet head 113 is situated above the head home 109 as shown in the drawings. The lamps 117, 118 are for example embedded in openings which are provided in the ceiling board 105 in such a way that an irradiation part of the lamp faces downward.

A method for forming a film on the substrate 100 by using the above-described droplet discharge device 101 is now described with reference to FIGS. 24 through 27. At the same time, the structure and the operation of the droplet discharge device according to the embodiment will be described more in detail. FIGS. 24 through 27 are sectional views showing the process of the film forming method according to the embodiment.

In the same way as the third embodiment, the openable wall 107*a* is opened and the substrate 100 is transported into the processing chamber 107 by the substrate carrier stage 103. At this point, the inkjet head 113 is situated above the head home 109U and the lamp 117 is placed above the processing chamber 107 (see FIG. 17). The head home 109U is purged by using an inactive gas.

The openable wall 107*a* is then closed thereby the processing chamber 107 becomes a closed space. Subsequently the processing chamber 107 is purged by an inactive gas (see FIG. 18). Here the substrate 100 can be cleaned by irradiating the substrate with the lamp 117 in the same way as the third embodiment.

Figure 24:
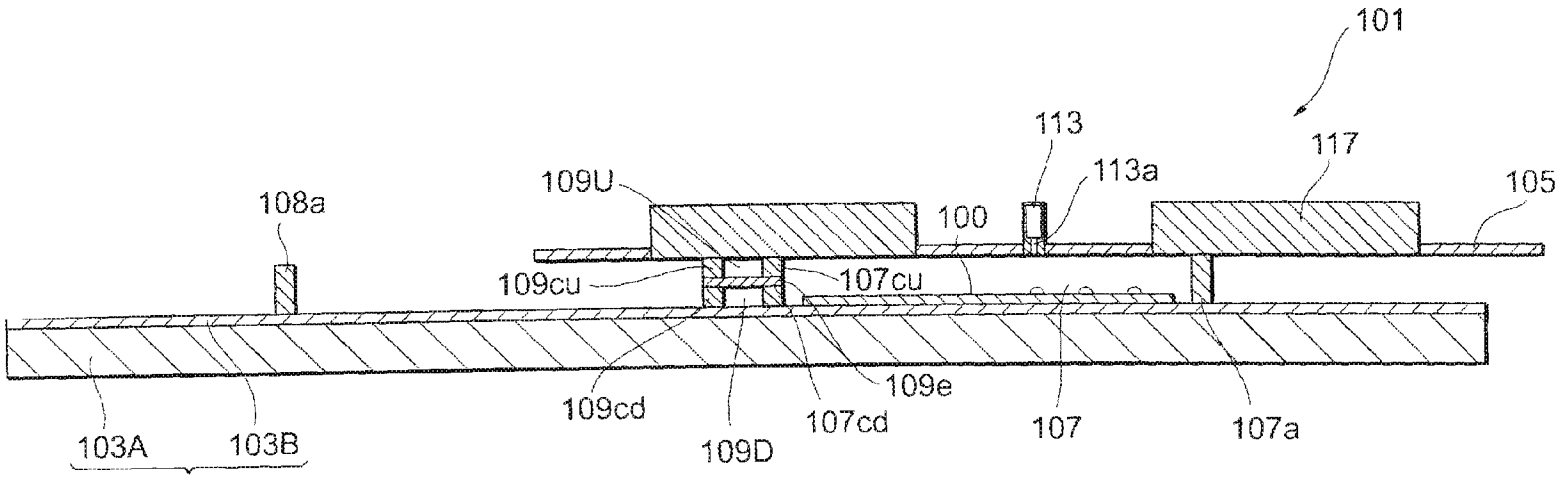
FIG. 24 is a sectional view showing a process of a film forming method according to the fourth embodiment.

Referring now to FIG. 24, the ink-jet head 113 is aligned with the area where a film is to be formed on the substrate 100 by sliding the ceiling board 105. Droplets are discharged from the ink-jet head 113. The ceiling board 105 is then moved to the left side in the drawing and droplets are sequentially discharged.

When the discharge onto the substrate 100 is finished, the ink-jet head 113 is returned to the original position above the head home 109U. Meanwhile, the wall 107*cu* can be made as the openable wall.

Figure 25:
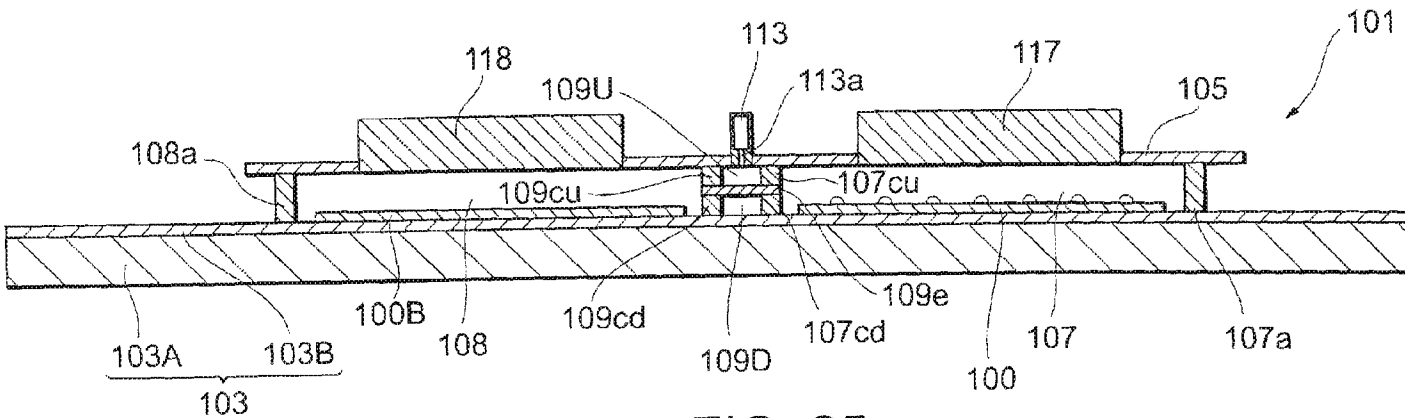
FIG. 25 is a sectional view showing a process of the film forming method according to the fourth embodiment.

When the ink-jet head 113 is returned to the above the head home 109U, the lamp 117 is placed over the processing chamber 107 (see FIG. 25). The inside of the processing chamber 107 is heated by the lamp 117 and droplets existing there are dried and baked (solidified). Consequently a film can be formed at a desired position on the substrate 100 in the same way as the first embodiment.

At the time of the heating treatment (heating process) by the lamp 117, the openable wall 108*a* is opened, a substrate 100B, which is the next substrate to be processed, is transported into the processing chamber 108, and the processing chamber 108 is purged by using an inactive gas. In the same manner as the third embodiment, the substrate 100B can be cleaned by irradiating the substrate with the lamp 118.

Referring to FIG. 21, the openable walls 117*cd*, 109*cd* are opened and the substrate 100 is transported through the transfer channel 109D. As described above, the ink-jet head 113 is stored inside the head home 109U at this point so that it will not contact with the external air. Alternatively the substrate 100 can be moved out through the openable wall 107*a*.

Figure 26:
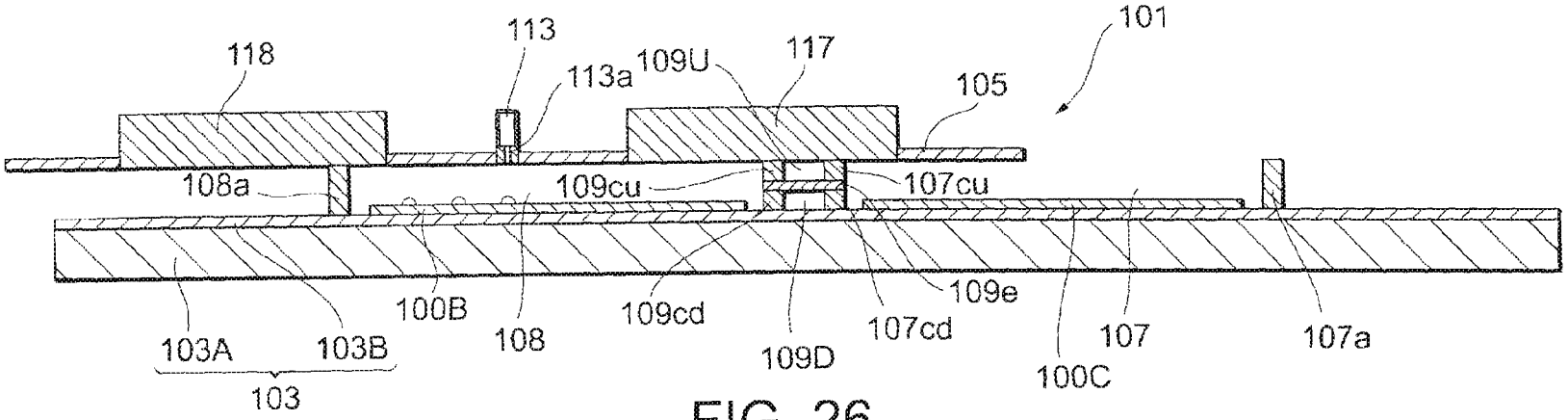
FIG. 26 is a sectional view showing a process of the film forming method according to the fourth embodiment.

Referring now to FIG. 26, the ink-jet head 113 is aligned with the area where a film is to be formed on the substrate 100B by sliding the ceiling board 105. Droplets are discharged from the ink-jet head 113. The ceiling board 105 is then moved to the right side in the drawing and droplets are sequentially discharged.

When the discharge onto the substrate 100B is finished, the ink-jet head 113 is returned to the original position above the head home 109U. Meanwhile, the wall 109*cu* can be made as the openable wall.

Figure 27:
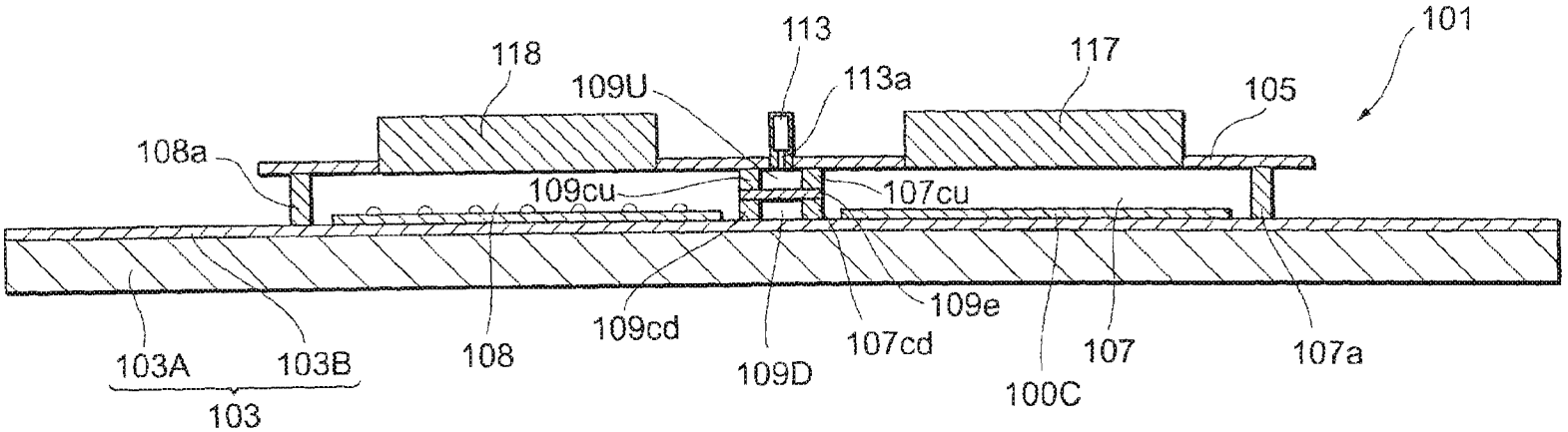
FIG. 27 is a sectional view showing a process of the film forming method according to the fourth embodiment.

When the ink-jet head 113 is returned to the above the head home 109U, the lamp 118 is placed over the processing chamber 108 (see FIG. 27). The inside of the processing chamber 108 is heated by the lamp 118 and droplets existing there are dried and baked. Consequently a film can be formed at a desired position on the substrate 100B in the same way as the first embodiment.

During the heating process by the lamp 118, a substrate 100C, which is the next substrate to be processed, is transported into the processing chamber 107 and the processing chamber 107 is purged by using an inactive gas. In the same manner as the third embodiment, the substrate 100C can be cleaned by irradiating the substrate with the lamp 117.

Subsequently, the droplet discharging, drying and baking process (film forming process) is performed to the substrate 100C in the same way as the substrate 100.

According to the fourth embodiment, while the film formation is conducted in one processing chamber, the other processing chamber can be purged by using an inactive gas. Therefore there is an advantage that film formation processes of more than one substrate can be efficiently performed, in addition to the same advantageous effects as those of the third embodiment.

The length of the ceiling board 105 in the left-right direction in the drawing can be changed. For example, referring to FIG. 24 and FIG. 26, the processing chamber in which the discharging operation is not performed can be covered with the ceiling board 105. In this case, while the film formation is conducted in one processing chamber, the other processing chamber can be purged by using an inactive gas and other film forming preparation of the next substrate can be carried out in the other processing chamber.

Fifth Embodiment

Figure 28:
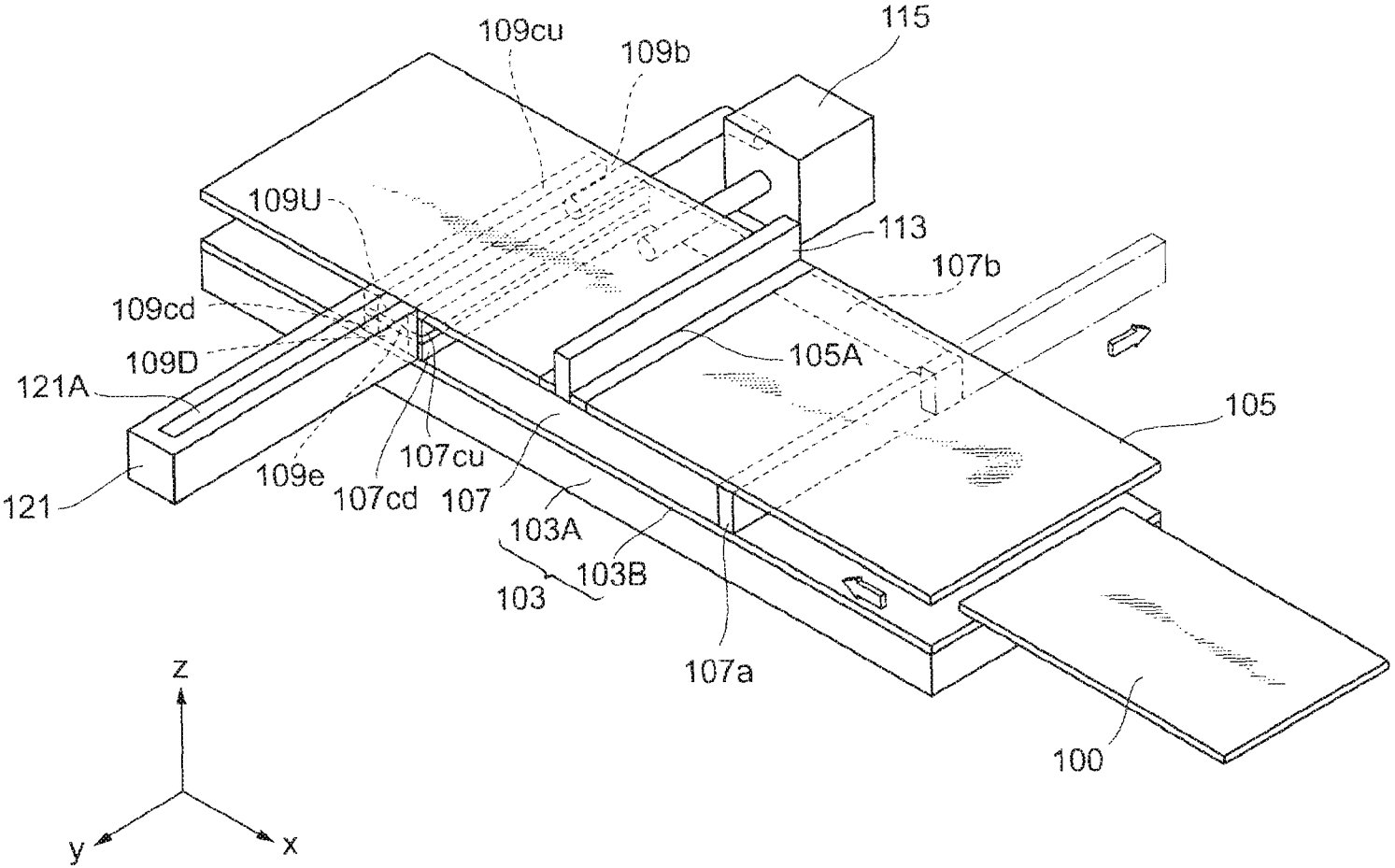
FIG. 28 is a perspective view of a droplet discharge device according to a fifth embodiment.
Figure 29:
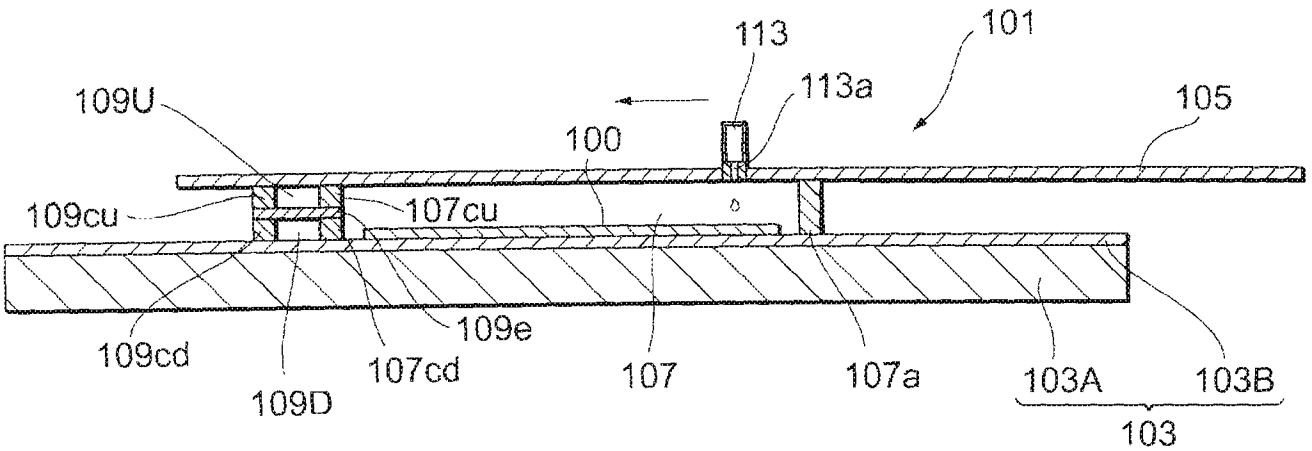
FIG. 29 is a sectional view of the droplet discharge device according to the fifth embodiment.

In a fifth embodiment of the invention, a maintenance room for the ink-jet head 113 is provided in the droplet discharge device. FIG. 28 and FIG. 29 show a droplet discharge device according to the fifth embodiment. FIG. 28 is a sectional view and FIG. 29 is a top view of the droplet discharge device. The identical numerals are given to the same structures as the first and third embodiments and those explanations are hereunder omitted.

Referring to FIG. 28 and FIG. 29, a maintenance room 121 (a maintenance part) which is coupled with the head home 109U is provided in the device according to the embodiment.

In this embodiment, the ink-jet head 113 is embedded in the ceiling board 105 such that the ink-jet head 113 is movable therein. More specifically, a guide 105A (a guiding groove or a carrier) in which the ink-jet head 113 is engaged is formed in the ceiling board 105 (see FIG. 32). Thereby the ink-jet head 113 can be moved along the guide 105A in the y-direction. A shutter which is moved in conjunction with the ink-jet head 113 can be further provided at the bottom of the guide. The shutter can prevent or reduce the external air from entering into the head home 109U.

Moreover, a guide 121A (a guiding groove or a carrier) is provided at the top of the maintenance room 121. The guides 105A and 121A are aligned by moving the ceiling board 105 and the ink-jet head 113 is slid in the y-direction. In this way the ink-jet head 113 can be transported into the maintenance room 121. The shutter moving in conjunction with the insertion movement of the ink-jet head 113 can also be provided in the guide 121A.

Figure 30:
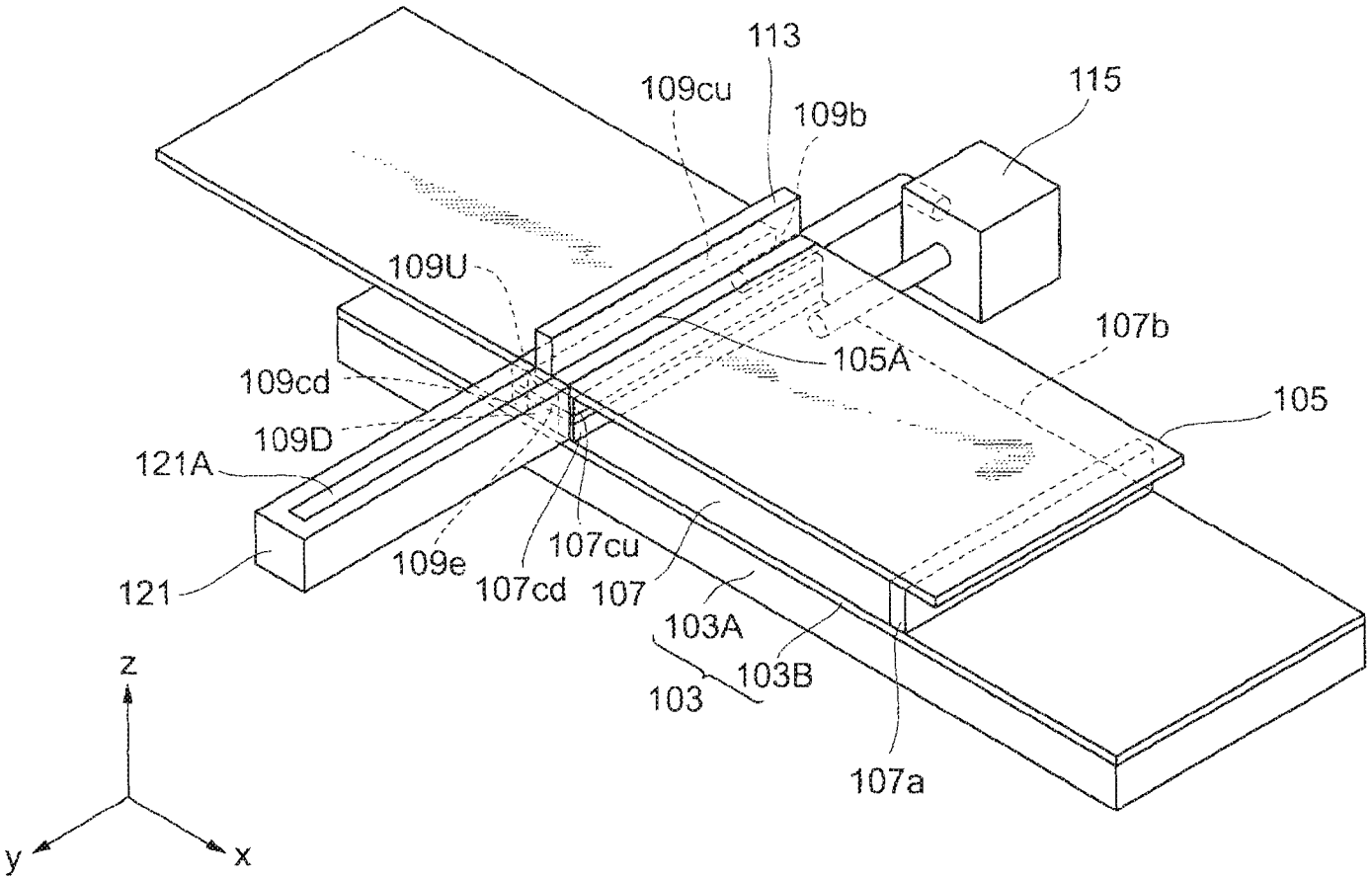
FIG. 30 is a perspective view showing a method for forming a film according to the fifth embodiment.
Figure 31:
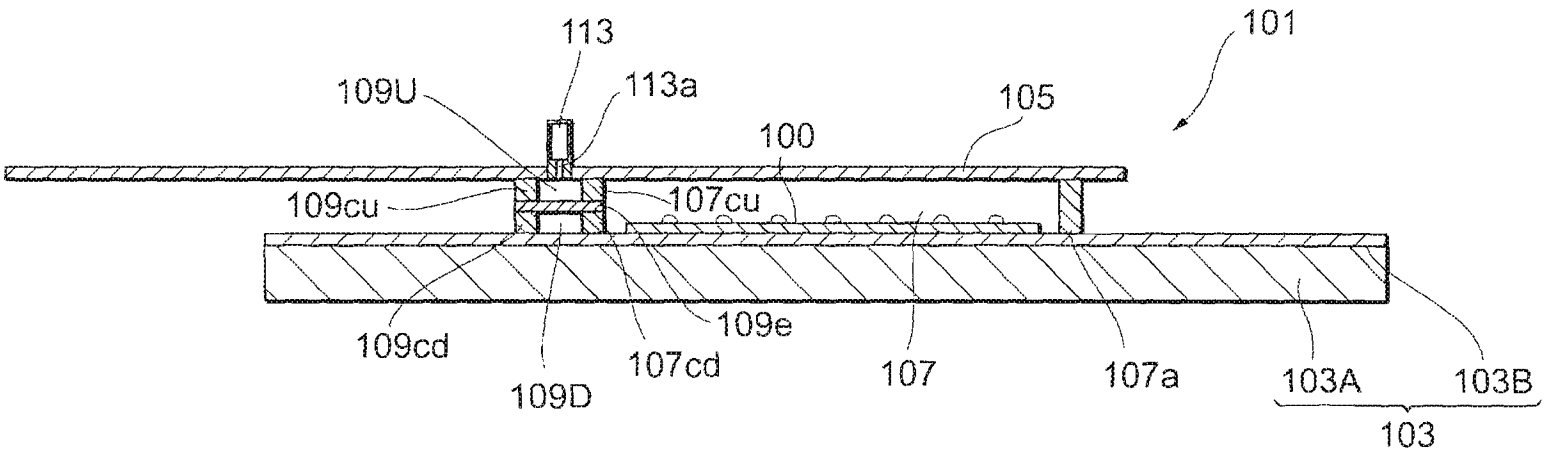
FIG. 31 is a sectional view showing the method for forming a film according to the fifth embodiment.
Figure 32:
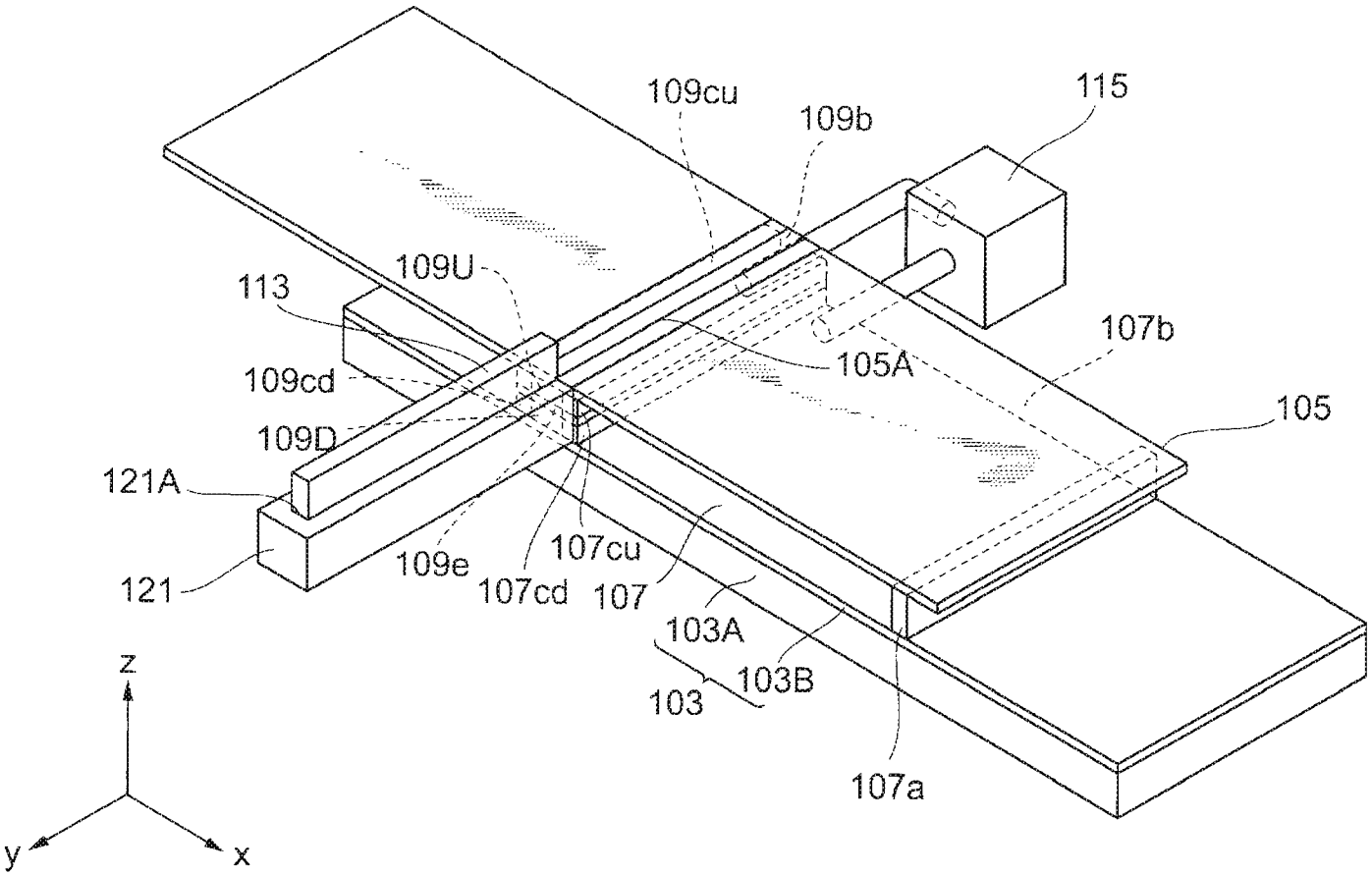
FIG. 32 is a perspective view showing the method for forming a film according to the fifth embodiment.

A method for carrying out the maintenance of the ink-jet head 113 is now described with reference to FIGS. 30 through 32. At the same time, the structure and the operation of the droplet discharge device according to the embodiment will be described more in detail. FIGS. 30 through 32 are sectional or perspective views showing the film forming method according to the embodiment. In the perspective view, walls including the wall 107*d* (see FIG. 2) and the like are not illustrated for the sake of simplicity.

For example, the ink-jet head 113 is moved in the x-direction in the scanning manner and droplets are discharged onto the substrate 100 as described in the first embodiment. Subsequently a heat treatment is performed and a film is formed. After the film formation process, the inkjet head 113 is returned to the head home 109U (see FIG. 30, FIG. 31). At this point, the guide 105A is coupled with the guide 121A. Thereby the ink-jet head 113 can be slid in the y-direction as shown in FIG. 32 and it can be placed in the maintenance room 121. For the smooth transportation of the ink-jet head, the wall 109*d* can be made an openable wall (for example the openable wall which opens and closes in the vertical direction, see FIG. 2), and the ink-jet head 113 can be transported through the openable wall.

According to the fifth embodiment, the maintenance room 121 is provided. Thereby the ink-jet head 113 is moved into the maintenance room 121 and the maintenance of the inkjet head can be carried out. Such maintenance includes cleaning of the nozzle opening of the inkjet head, cleaning droppings of the liquid around the nozzle opening, replacement of the ink-jet head 113 and the like.

Where a cleaning part (cleaner) is provided in the maintenance room 121, the cleaning can be automatically carried out in the maintenance room 121. Moreover, the bottom part of the maintenance room 121 can be made openable, the inkjet head 121 is removed from the maintenance room 121 and the cleaning or the like can be then performed. Furthermore, the replacement, of the ink-jet head 113 can be carried out by making use of the space (room, replacing part) of the maintenance room 121. The maintenance room 121 is provided separately from the processing chamber 107 so that the air will not enter into the processing chamber 107.

The maintenance room 121 is disposed in the direction (y-direction) orthogonal to the scanning direction (x-direction) of the ceiling board 105 (ink-jet head 113) according to the embodiment. Thereby the ink-jet head 113 can be easily transported to the maintenance room 121.

In this way, the maintenance can be efficiently carried out according to the embodiment.

Sixth Embodiment

The nozzle openings are arranged in a line in the ink-jet head 113 (see FIG. 2) according to the above-described first-fifth embodiments. However the shape of the ink-jet head 113 and the layout of the nozzle openings are not limited to the above-described embodiments.

For example, a single nozzle opening can be provided in the ink-jet head or the nozzle openings can be arranged in more than one line in the ink-jet head.

Figure 33:
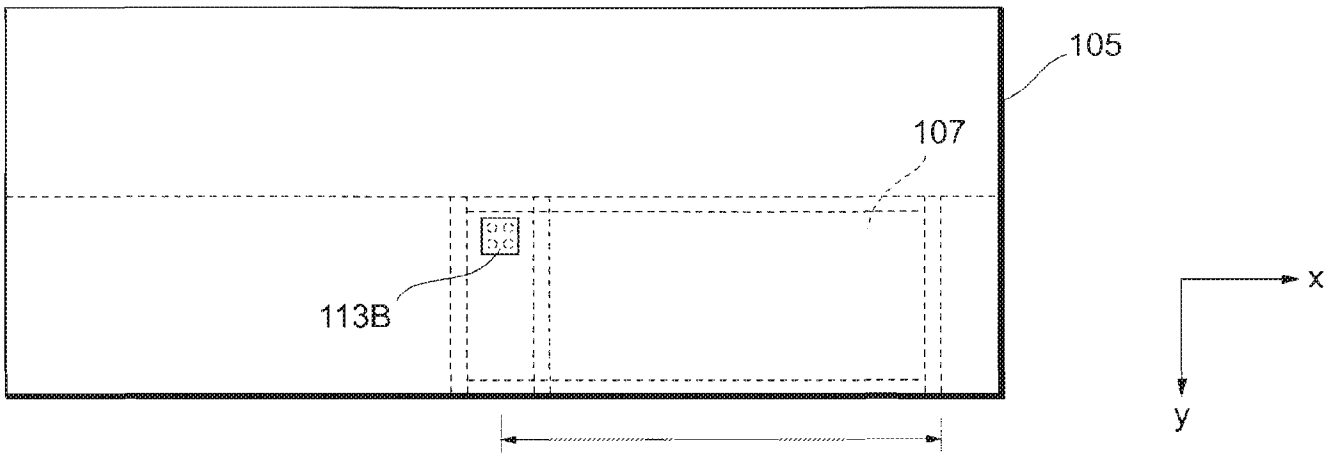
FIG. 33 is a top view of a droplet discharge device according to a sixth embodiment.

FIG. 33 and FIG. 24 are top views of the droplet discharge device according to a sixth embodiment. Referring to the drawings, the nozzle openings are arranged in 2×2 in an inkjet head 113B, and the ink-jet head is embedded in the ceiling board 105. The identical numerals are given to the same structures as the first and third embodiments and those explanations are hereunder omitted.

Figure 34:
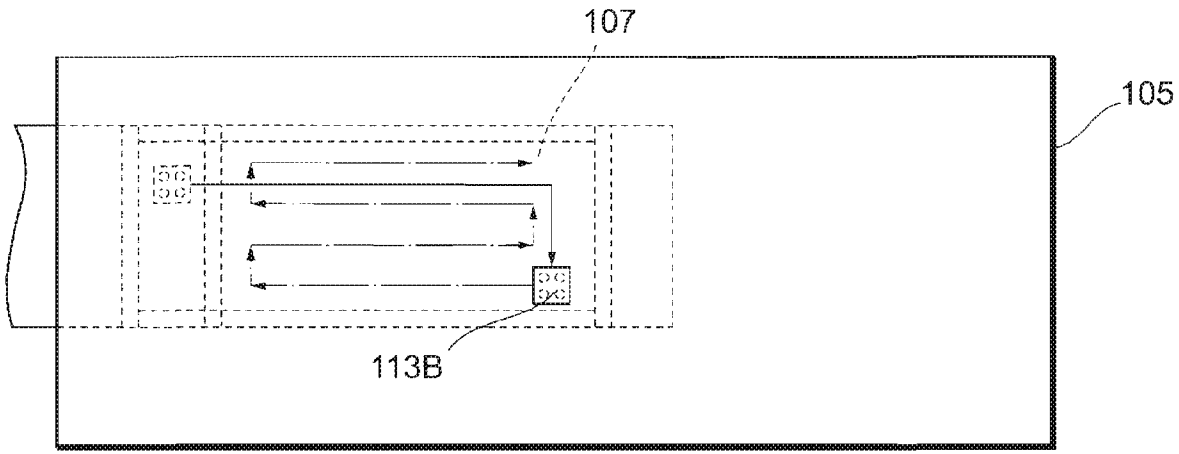
FIG. 34 is a top view of the droplet discharge device according to the sixth embodiment.

The inkjet head 113B moves from the head home 109U to the edge of the processing chamber 107 (substrate) (the lower right in the drawing), and starts discharging (scanning). At this point, the processing chamber 107 should be covered with the ceiling board 105 so that the adjustment of the width (length) of the ceiling board 105 in the y-direction is needed. For example, by setting the length of the ceiling board to twice the width (length) of the processing chamber 107 in the y-direction, the ceiling board can sufficiently cover the processing chamber 107. Referring to FIG. 34, the arrow drawn with a solid line designates an example of an initial transportation route for the ink-jet head 113 and the arrow drawn with an alternate long and short dash line designates an example of an scanning route of the ink-jet head 113B.

The invention can be applied to any device irrespectively of the size of the inkjet head 113B and the number of the nozzle openings.

Though the fabrication of a color filter for a liquid crystal device has been described in the above embodiments as an example, the device and the film forming method according to the embodiments can also be applied to other discharge operations discharging for example an alignment film material and liquid crystal. In addition to the liquid crystal device, the invention can be applied to a discharge operation discharging a liquid electrode material and the like for an organic electrolumilinescence (EL) device, a surface-conduction electron-emitting device and so on. The invention can also be applied to an discharge operation discharging a biomaterial organic substance used for fabrication of a bio-chip. The invention obviously can be applied to an ink-jet printer. The invention can be applied in a wide range of fields however the most appropriate field is the above-mentioned industrial-use droplet discharge device. Particularly, the invention is preferably applied to the discharge operation discharging an organic solvent and an organic EL material which can be easily deteriorated by contacting the air.

The invention is obviously not limited to the specific embodiments described herein, but also encompasses any variations that may be considered by any person skilled in the art, within the general scope of the invention. Note that the invention encompasses the substantially same elements and components as those described in the above-described embodiments, the embodiments can be appropriately combined according to an application and any change or improvement can be added in order to work the invention.

What is claimed is:

1. A film forming apparatus, comprising:

a processing chamber, the film being formed in the processing chamber;

an application preparation room in which an applicator is temporarily provided, the application preparation room being disposed adjacent to the processing chamber;

a gas supplier supplies a gas into at least one of the processing chamber and the application preparation room;

a first carrier that transports the applicator from the application preparation room to the processing chamber;

a stage, a substrate being disposed on the stage; and a maintenance room that maintains the applicator, the maintenance room being disposed outside of the application preparation room, and an openable wall being disposed between the application preparation room and the maintenance room;

a liquid being applied from the applicator to the substrate to form the film on the substrate.

2. The film forming apparatus according to claim 1, wherein the processing chamber is a closed space defined by at least one wall, the first carrier and a part having the stage.

3. The film forming apparatus according to claim 1, wherein the stage serves as a second carrier that transports the substrate to the processing chamber.

4. The film forming apparatus according to claim 1, wherein the applicator is transported from the application preparation room to the maintenance room by a third carrier.

5. The film forming apparatus according to claim 1, wherein the applicator is transported in a first direction and the maintenance room is disposed in a second direction that crosses the first direction of the application preparation room.

6. The film forming apparatus according to claim 1, the maintenance room further including a cleaner part for cleaning the applicator.

7. The film forming apparatus according to claim 1, further comprising a space for replacing the applicator in the maintenance room.

8. The film forming apparatus according to claim 1, wherein the first carrier is a plate-shaped member that covers an upper part of the processing chamber and the applicator is embedded in the plate-shaped member.

9. The film forming apparatus according to claim 8, further comprising a heater embedded in the plate-shaped member.

10. The film forming apparatus according to claim 9, wherein the heater is embedded in the plate-shaped member such that the heater is situated in the processing chamber when the applicator is situated in the application preparation room.

11. The film forming apparatus according to claim 1, wherein the application preparation room is outside and adjacent to the processing chamber.

12. The film forming apparatus according to claim 1, wherein both the application preparation room and the processing chamber are enclosed to substantially prevent air and gas outside of the application preparation room and the processing chamber from entering the application preparation room and the processing chamber.

* * * * *